US012043883B2

(12) United States Patent
Hirashima et al.

(10) Patent No.: US 12,043,883 B2
(45) **Date of Patent: *Jul. 23, 2024**

(54) HIGH-YIELD-RATIO HIGH-STRENGTH ELECTROGALVANIZED STEEL SHEET AND METHOD FOR MANUFACTURING THE SAME

(71) Applicant: JFE Steel Corporation, Tokyo (JP)

(72) Inventors: Takuya Hirashima, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 572 days.

This patent is subject to a terminal disclaimer.

(21) Appl. No.: 17/284,933

(22) PCT Filed: Aug. 6, 2019

(86) PCT No.: PCT/JP2019/030792

§ 371 (c)(1),
(2) Date: Apr. 13, 2021

(87) PCT Pub. No.: WO2020/079925

PCT Pub. Date: Apr. 23, 2020

(65) Prior Publication Data

US 2021/0381085 A1 Dec. 9, 2021

(30) Foreign Application Priority Data

Oct. 18, 2018 (JP) ..... 2018-196590

(51) Int. Cl.

| | |
|---|---|
| ***C22C 38/02*** | (2006.01) |
| ***C21D 8/02*** | (2006.01) |
| ***C21D 9/46*** | (2006.01) |
| ***C22C 38/04*** | (2006.01) |
| ***C22C 38/06*** | (2006.01) |
| ***C25D 5/36*** | (2006.01) |

(52) U.S. Cl.

CPC ..... *C22C 38/02* (2013.01); *C21D 8/0226* (2013.01); *C21D 8/0236* (2013.01); *C21D 8/0273* (2013.01); *C21D 9/46* (2013.01); *C22C 38/04* (2013.01); *C22C 38/06* (2013.01); *C25D 5/36* (2013.01); *C21D 2211/002* (2013.01); *C21D 2211/008* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 8,449,988 | B2 | 5/2013 | Shiraki et al. | |
| 9,121,087 | B2 | 9/2015 | Matsuda et al. | |
| 2012/0132327 | A1* | 5/2012 | Mukai | C21D 8/0236 148/333 |
| 2013/0199679 | A1* | 8/2013 | Toji | B21D 22/022 148/653 |
| 2014/0087208 | A1 | 3/2014 | Toda et al. | |
| 2017/0218475 | A1 | 8/2017 | Kawasaki et al. | |
| 2019/0003009 | A1 | 1/2019 | Kawata et al. | |
| 2019/0203317 | A1 | 7/2019 | Yoshioka et al. | |
| 2020/0032364 | A1* | 1/2020 | Hirashima | C21D 8/0226 |
| 2020/0190617 | A1 | 6/2020 | Hasegawa et al. | |

FOREIGN PATENT DOCUMENTS

| | | | |
|---|---|---|---|
| EP | 3489382 | A1 | 5/2019 |
| EP | 3550050 | A1 | 10/2019 |
| JP | 07197183 | A | 8/1995 |
| JP | 200080418 | A | 3/2000 |
| JP | 2010090475 | A | 4/2010 |
| JP | 2011231377 | A | 11/2011 |
| JP | 2011246746 | A | 12/2011 |
| KR | 20160072898 | A | 6/2016 |
| WO | 2012161241 | A1 | 11/2012 |
| WO | 2017164346 | A1 | 9/2017 |
| WO | 2018062380 | A1 | 4/2018 |
| WO | 2018062381 | A1 | 4/2018 |
| WO | 2018123356 | A1 | 7/2018 |

(Continued)

OTHER PUBLICATIONS

Final Office Action for U.S. Appl. No. 16/960,733, mailed May 23. 2022, 27 pages.

Kodym, M. et al., Autorenkollektiv: "Spurenelemente im Stahl—Meoglichkeiten zur Beeinflussung im Smelzbetrieb, Trace Elements in Steel—Possibilities for Influencing the Smelting Operation," Jan. 1, 1985, 1 page, XP002433212 (partial English translation of relevant parts).

Bell, S., et al., "Final Report on Effect of Impurities in Steel," Report No. 2005-41(CF), Mar. 1, 2006, 24 pages, XP009508207, Final Report of Natural Resources Canada, Natural Resources Canada, Retrieved from the Internet: https://www.researchgate.net/publication/306293969?channel=doi&linkId=57b7493708aec9984ff2a51f&showFulltext=true.

Extended European Search Report for European Application No. 19 873 058.2, dated May 4, 2021, 10 pages.

Chinese Office Action with Search Report for Chinese Application No. 201980068496.7, dated Jan. 26, 2022, 9 pages.

(Continued)

*Primary Examiner* — Jophy S. Koshy

(74) *Attorney, Agent, or Firm* — Buchanan Ingersoll & Rooney PC

(57) ABSTRACT

A high-yield-ratio high-strength electrogalvanized steel sheet having an electrogalvanized coating layer formed on a surface of a base steel sheet, in which the base steel sheet has a certain chemical composition, and a steel microstructure, in which a total area fraction of one or both of bainite containing carbides having an average grain diameter of 50 nm or less and tempered martensite containing carbides having an average grain diameter of 50 nm or less is 90% or more in the whole of the steel microstructure, and in which a total area fraction of one or both of the bainite containing and the tempered martensite containing carbides is 80% or more in a region from the surface of the base steel sheet to a position located at ⅛ of a thickness of the base steel sheet, and diffusible hydrogen in steel in an amount of 0.20 mass ppm or less.

36 Claims, No Drawings

(56) References Cited

FOREIGN PATENT DOCUMENTS

| | | |
|---|---|---|
| WO | 2018124157 A1 | 7/2018 |
| WO | 2018146828 A1 | 8/2018 |

OTHER PUBLICATIONS

International Search Report and Written Opinion for International Application No. PCT/JP2019/030792, dated Oct. 1, 29, 2019, 6 pages.

Korean Office Action for Korean Application No. 10-2021-7011162, dated Oct. 1, 2022, with Concise Statement of Relevance of Office Action, 7 pages.

* cited by examiner

HIGH-YIELD-RATIO HIGH-STRENGTH ELECTROGALVANIZED STEEL SHEET AND METHOD FOR MANUFACTURING THE SAME

CROSS REFERENCE TO RELATED APPLICATIONS

This is the U.S. National Phase application of PCT/JP2019/030792, filed Aug. 6, 2019, which claims priority to Japanese Patent Application No. 2018-196590, filed Oct. 18, 2018, the disclosures of these applications being incorporated herein by reference in their entireties for all purposes.

FIELD OF THE INVENTION

The present invention relates to a high-yield-ratio high-strength electrogalvanized steel sheet and a method for manufacturing the steel sheet. In more detail, the present invention relates to a high-yield-ratio high-strength electrogalvanized steel sheet which is used for automobile parts and the like and a method for manufacturing the steel sheet, and, in particular, to a high-yield-ratio high-strength electrogalvanized steel sheet having excellent bendability and a method for manufacturing the steel sheet.

BACKGROUND OF THE INVENTION

Nowadays, since there is an active trend toward decreasing the weight of an automobile body, the strength of a steel sheet which is used for an automobile body is being increased to decrease the thickness of the steel sheet and to thereby decrease the weight of the automobile body. In particular, there has been a growing trend toward using a high-strength steel sheet having a TS (tensile strength) of 1320 MPa to 1470 MPa class for automobile body skeleton parts such as those for center pillar R/F (reinforcement), bumpers, impact beam parts, and the like (hereinafter, also referred to as "parts"). Moreover, consideration is also being given to using a steel sheet having strength represented by a TS of 1800 MPa class (1.8 GPa class) or above to further decrease the weight of an automobile body. In addition, there is an increasing demand for a steel sheet having a high yield ratio from the viewpoint of collision safety.

There is concern of delayed fracturing (hydrogen embrittlement) occurring due to an increase in the strength of a steel sheet. Nowadays, due to a coating layer, it becomes difficult to release hydrogen which enters a steel sheet in the manufacturing process of the steel sheet, which suggests an increased risk of fracturing occurring when the steel sheet is subjected to stress.

For example, Patent Literature 1 discloses a technique for improving delayed fracture resistance by controlling the amount of carbides. Specifically, Patent Literature 1 provides an ultrahigh-strength steel sheet having a tensile strength of 980 MPa or more and good delayed fracture resistance, the steel sheet having a chemical composition containing, by mass %, C: 0.05% to 0.25%, Mn: 1.0% to 3.0%, S: 0.01% or less, Al: 0.025% to 0.100%, and N: 0.008% or less and a microstructure in which the amount of precipitates having a grain diameter of 0.1 μm or less in martensite is $3\times10^5/m^2$ or less.

In addition, Patent Literature 2 provides a high-strength steel sheet having a high yield ratio, excellent bendability, and a tensile strength of 1.0 GPa to 1.8 GPa, the steel sheet having a chemical composition containing, by mass %, C: 0.12% to 0.3%, Si: 0.5% or less, Mn: less than 1.5%, P: 0.02% or less, S: 0.01% or less, Al: 0.15% or less, N: 0.01% or less, and a balance of Fe and inevitable impurities and a tempered martensite single-phase structure.

In addition, Patent Literature 3 provides a high-strength steel sheet having an excellent strength-ductility balance and a tensile strength of 980 MPa to 1.8 GPa, the steel sheet having a chemical composition containing, by mass %, C: 0.17% to 0.73%, Si: 3.0% or less, Mn: 0.5% to 3.0%, P: 0.1% or less, S: 0.07% or less, Al: 3.0% or less, N: 0.010% or less, and a balance of Fe and inevitable impurities and a microstructure in which a martensite phase is formed to increase strength, in which retained austenite necessary to realize a TRIP effect is stably formed by utilizing upper bainite transformation, and in which some portion of martensite is made into tempered martensite.

PATENT LITERATURE

PTL 1: Japanese Unexamined Patent Application Publication No. 7-197183

PTL 2: Japanese Unexamined Patent Application Publication No. 2011-246746

PTL 3: Japanese Unexamined Patent Application Publication No. 2010-90475

SUMMARY OF THE INVENTION

Since a steel sheet which is used for an automobile body is subjected to press forming, fracturing occurring in the steel sheet starts at an end surface which is formed when shearing or punching is performed (hereinafter, referred to as "sheared end surface") in many cases. Moreover, it is clarified that such fracturing tends to be caused by hydrogen which exists in steel. Therefore, it is necessary to evaluate fracturing by evaluating crack growth from a sheared end surface. In addition, when a steel sheet is subjected to forming for use in an automobile, stress is applied by performing bending work. Therefore, to evaluate fracturing, it is necessary to evaluate bendability by performing bending work on a small piece having a sheared end surface.

In the case of the technique disclosed in Patent Literature 1, delayed fracturing is evaluated by immersing a test piece in an acidic solution for a certain time after applying bending stress to the test piece and by applying an electrical potential to cause hydrogen to enter the steel. However, in such a test, since delayed fracturing is evaluated by forcibly causing hydrogen to enter the steel sheet, it is not possible to evaluate the effect of hydrogen which enters a steel sheet in the manufacturing process of the steel sheet.

In the case of the technique disclosed in Patent Literature 2, although it is possible to achieve excellent strength as a result of forming a tempered martensite single-phase structure, since it is not possible to decrease the amount of inclusions, which promote crack growth, it is considered that there is no improvement in bendability.

In the case of the technique disclosed in Patent Literature 3, although there is no mention of bendability, it is considered that there is no improvement in bendability, because it is considered that the amount of diffusible hydrogen in steel is large in the steel specified by Patent Literature 3, in which a large amount of austenite is utilized. This is because the amount of solid solution hydrogen is larger in austenite, which has an FCC structure, than in martensite or bainite, which has a BCC structure or a BCT structure.

An object according to aspects of the present invention is to provide a high-yield-ratio high-strength electrogalvanized steel sheet having excellent bendability and a method for manufacturing the steel sheet.

Here, in accordance with aspects of the present invention, the expression "high-yield-ratio high-strength" denotes a case of a yield ratio of 0.80 or more and a tensile strength of 1320 MPa or more.

In addition, the expression "the surface of a base steel sheet" of an electrogalvanized steel sheet denotes the interface between the base steel sheet and the electrogalvanized coating layer.

In addition, a region from the surface of the base steel sheet to a position located at ⅛ of the thickness of the base steel sheet is referred to as a "surface layer".

The present inventors diligently conducted investigations to solve the problems described above and, as a result, found that it is necessary to decrease the amount of diffusible hydrogen in steel to 0.20 mass ppm or less to achieve excellent bendability. In addition, the present inventors found that diffusible hydrogen in steel is released by cooling the steel sheet to a low temperature before an electrogalvanizing treatment is performed and succeeded in manufacturing an electrogalvanized steel sheet having excellent bendability. In addition, it was found that, by performing rapid cooling in such a cooling process, it is possible to form a microstructure mainly including tempered martensite and bainite and to thereby achieve a high yield ratio and high strength.

As described above, the present inventors conducted various investigations to solve the problems described above and, as a result, found that it is possible to obtain a high-yield-ratio high-strength electrogalvanized steel sheet having excellent bendability by decreasing the amount of diffusible hydrogen in steel and completed in accordance with aspects of the present invention. The subject matter of aspects of the present invention is as follows.

[1] A high-yield-ratio high-strength electrogalvanized steel sheet having an electrogalvanized coating layer formed on a surface of a base steel sheet, in which the base steel sheet has a chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.010% or less, and a balance of Fe and inevitable impurities, a steel microstructure, in which a total area fraction of one or both of bainite containing carbides having an average grain diameter of 50 nm or less and tempered martensite containing carbides having an average grain diameter of 50 nm or less is 90% or more in the whole of the steel microstructure, and in which a total area fraction of one or both of bainite containing carbides having an average grain diameter of 50 nm or less and tempered martensite containing carbides having an average grain diameter of 50 nm or less is 80% or more in a region from the surface of the base steel sheet to a position located at ⅛ of a thickness of the base steel sheet, and diffusible hydrogen in steel in an amount of 0.20 mass ppm or less.

[2] The high-yield-ratio high-strength electrogalvanized steel sheet according to item [1], in which the base steel sheet has the chemical composition and the steel microstructure, the steel microstructure includes carbides having an average grain diameter of 0.1 μm or more and inclusions, and a sum of perimeters of the carbides having an average grain diameter of 0.1 μm or more and the inclusions is 50 μm/mm$^2$ or less.

[3] The high-yield-ratio high-strength electrogalvanized steel sheet according to item [1] or [2], in which the chemical composition further contains, by mass %, B: 0.0002% or more and less than 0.0035%.

[4] The high-yield-ratio high-strength electrogalvanized steel sheet according to any one of items [1] to [3], in which the chemical composition further contains, by mass %, one or both selected from Nb: 0.002% or more and 0.08% or less and Ti: 0.002% or more and 0.12% or less.

[5] The high-yield-ratio high-strength electrogalvanized steel sheet according to any one of items [1] to [4], in which the chemical composition further contains, by mass %, one or both selected from Cu: 0.005% or more and 1% or less and Ni: 0.01% or more and 1% or less.

[6] The high-yield-ratio high-strength electrogalvanized steel sheet according to any one of items [1] to [5], in which the chemical composition further contains, by mass %, one, two, or more selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less.

[7] The high-yield-ratio high-strength electrogalvanized steel sheet according to any one of items [1] to [6], in which the chemical composition further contains, by mass %, one, two, or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less.

[8] The high-yield-ratio high-strength electrogalvanized steel sheet according to any one of items [1] to [7], in which the chemical composition further contains, by mass %, one or both selected from Sb: 0.002% or more and 0.1% or less and Sn: 0.002% or more and 0.1% or less.

[9] A method for manufacturing a high-yield-ratio high-strength electrogalvanized steel sheet, the method including a hot rolling process of performing hot rolling on a steel slab having the chemical composition according to any one of items [1] to [8] with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet, an annealing process of holding the steel sheet obtained in the hot rolling process at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds, and an electroplating process of cooling the steel sheet after the annealing process to room temperature and performing an electrogalvanizing treatment on the cooled steel sheet for an electrogalvanizing time of 300 seconds or less.

[10] The method for manufacturing a high-yield-ratio high-strength electrogalvanized steel sheet according to item [9], the method further including a cold rolling process of performing cold rolling on the steel sheet after the hot rolling process between the hot rolling process and the annealing process.

[11] The method for manufacturing a high-yield-ratio high-strength electrogalvanized steel sheet according to item [9] or [10], the method further including a tempering process of holding the steel sheet after the electroplating process in a temperature range of 250° C. or lower for a holding time t which satisfies relational expression (1) below.

$$(T+273)(\log t+4)\leq 2700 \quad (1)$$

Here, in relational expression (1), T denotes a holding temperature (° C.) in the tempering process and t denotes the holding time (sec) in the tempering process.

[12] The method for manufacturing a high-yield-ratio high-strength electrogalvanized steel sheet according to any one of items [9] to [11], in which a rolling time in a temperature range from a temperature of 1150° C. to the finishing delivery temperature in the hot rolling process is 200 seconds or less.

In accordance with aspects of the present invention, by controlling the chemical composition and the manufacturing method, the steel microstructure is controlled so that there is a decrease in the amount of diffusible hydrogen in steel. As a result, the high-yield-ratio high-strength electrogalvanized steel sheet according to aspects of the present invention has excellent bendability.

By using the high-yield-ratio high-strength electrogalvanized steel sheet according to aspects of the present invention for the structural members of an automobile, it is possible to obtain a steel sheet for an automobile having both increased strength and improved bendability. That is, aspects of the present invention provide an automobile body with enhanced performance.

DETAILED DESCRIPTION OF EMBODIMENTS OF THE INVENTION

Hereafter, the embodiments of the present invention will be described. Here, the present invention is not limited to the embodiments below.

The high-yield-ratio high-strength electrogalvanized steel sheet according to aspects of the present invention has an electrogalvanized coating layer formed on the surface of a steel sheet, which is the material of the high-yield-ratio high-strength electrogalvanized steel sheet, that is, a base steel sheet.

First, the chemical composition of the base steel sheet (hereafter, also simply referred to as "steel sheet") according to aspects of the present invention will be described. In the description of the chemical composition below, "%", which is a unit of the content of each of the constituents of the chemical composition, denotes "mass %".

C: 0.14% or More and 0.40% or Less

Since C is an element which improves hardenability, C is necessary to achieve a predetermined area fraction of tempered martensite and/or bainite. In addition, C is necessary to increase the strength of tempered martensite and bainite and to thereby achieve a TS of 1320 MPa or more and a YR of 0.80 or more. In addition, as a result of hydrogen in steel being trapped due to carbides being finely dispersed, since there is a decrease in the amount of diffusible hydrogen in steel, there is an improvement in bendability. In the case where the C content is less than 0.14%, it is not possible to achieve excellent bendability or predetermined strength. Therefore, the C content is set to be 0.14% or more. Here, it is preferable that the C content be more than 0.18% or more preferably 0.20% or more to achieve higher TS, that is, a TS of 1470 MPa or more. On the other hand, in the case where the C content is more than 0.40%, since there is an increase in the grain diameter of carbides inside tempered martensite and bainite, there is a deterioration in bendability. Therefore, the C content is set to be 0.40% or less, preferably 0.38% or less, or more preferably 0.36% or less.

Si: 0.001% or More and 2.0% or Less

Si is an element which increases strength through solid solution strengthening. In addition, when a steel sheet is tempered at a temperature range of 200° C. or higher, Si contributes to improving bendability by inhibiting the formation of an excessive amount of carbides having a large grain dimeter. Moreover, Si also contributes to inhibiting the formation of MnS by decreasing the amount of Mn segregated in the central portion in the thickness direction. In addition, Si also contributes to inhibiting decarburization and deboronization due to oxidation of the surface layer of a steel sheet when continuous annealing is performed. Here, to sufficiently realize the effects described above, the Si content is set to be 0.001% or more, preferably 0.003% or more, or more preferably 0.005% or more. On the other hand, in the case where the Si content is excessively high, since the segregation of Si is expanded in the thickness direction, MnS having a large grain diameter tends to be formed in the thickness direction, which results in a deterioration in bendability. Therefore, the Si content is set to be 2.0% or less, preferably 1.5% or less, or more preferably 1.2% or less.

Mn: 0.10% or More and 1.70% or Less

Mn is added to improve the hardenability of steel and to thereby achieve a predetermined area fraction of tempered martensite and/or bainite. In the case where the Mn content is less than 0.10%, since ferrite is formed in the surface layer of a steel sheet, there is a decrease in strength and yield ratio. Therefore, the Mn content is set to be 0.10% or more, preferably 0.40% or more, or more preferably 0.80% or more. On the other hand, Mn is an element which particularly promotes the formation of MnS and an increase in the grain diameter thereof. In the case where the Mn content is more than 1.70%, since there is an increase in the amount of inclusions having a large grain diameter, there is a marked deterioration in bendability. Therefore, the Mn content is set to be 1.70% or less, preferably 1.60% or less, or more preferably 1.50% or less.

P: 0.05% or Less

P is an element which increases the strength of steel. However, in the case where the P content is high, since crack generation is promoted, there is a marked deterioration in bendability. Therefore, the P content is set to be 0.05% or less, preferably 0.03% or less, or more preferably 0.01% or less. Here, although there is no particular limitation on the lower limit of the P content, the lower limit within an industrially feasible range is about 0.003% at present.

S: 0.0050% or Less

Since S has a strong negative effect on bendability through the formation of MnS, TiS, Ti(C, S), or the like, it is necessary to strictly control the S content. To decrease such a negative effect due to inclusions, it is necessary that the S content be 0.0050% or less, preferably 0.0020% or less, more preferably 0.0010% or less, or even more preferably 0.0005% or less. Here, although there is no particular limitation on the lower limit of the S content, the lower limit within an industrially feasible range is about 0.0002% at present.

Al: 0.01% or More and 0.20% or Less

Al is added to sufficiently perform deoxidation and thereby to decrease the amount of inclusions having a large grain diameter in steel. To realize such an effect, the Al content is set to be 0.01% or more or preferably 0.02% or more. On the other hand, in the case where the Al content is more than 0.20%, since carbides such as cementite which are formed when coiling is performed after hot rolling has been performed and which contain mainly Fe are less likely to form a solid solution in an annealing process, inclusions and carbides having a large grain diameter are formed, which results in a deterioration in bendability. Therefore, the Al content is set to be 0.20% or less, preferably 0.17% or less, or more preferably 0.15% or less.

N: 0.010% or Less

Since N is an element which forms nitride- and carbonitride-based inclusions having a large grain diameter such as TiN, (Nb, Ti) (C, N), and AlN in steel, N causes a deterioration in bendability through the formation of such inclusions. To prevent a deterioration in bendability, it is necessary that the N content be 0.010% or less, preferably 0.007% or less, or more preferably 0.005% or less. Here, although there is no particular limitation on the lower limit of the N content, the lower limit within an industrially feasible range is about 0.0006% at present.

The steel sheet according to aspects of the present invention has a chemical composition containing the constituents described above and a balance being Fe (iron) and inevitable impurities. The steel sheet according to aspects of the present invention preferably has the chemical composition consisting of the constituents described above and the balance being Fe and inevitable impurities. The steel sheet according to aspects of the present invention may further contain the constituents described below as optional constituents. Here, in the case where one of the optional constituents described below is contained in an amount less than the lower limit of the content of such a constituent, such a constituent is regarded as being contained as an inevitable impurity.

B: 0.0002% or More and Less than 0.0035%

Since B is an element which improves the hardenability of steel, it is possible to realize the effect of achieving a predetermined area fraction of tempered martensite and bainite as a result of B being added, even in the case where the Mn content is low. To realize such an effect of B, the B content is set to be 0.0002% or more, preferably 0.0005% or more, or more preferably 0.0007% or more. In addition, to fix N, it is preferable that B be added in combination with Ti whose content is 0.002% or more. On the other hand, in the case where the B content is 0.0035% or more, since there is a decrease in the dissolution rate of cementite when annealing is performed, carbides such as cementite which contain mainly Fe remain undissolved. As a result, since inclusions and carbides having a large grain diameter are formed, there is a deterioration in bendability. Therefore, the B content is set to be less than 0.0035%, preferably 0.0030% or less, or more preferably 0.0025% or less.

One or Both Selected from Nb: 0.002% or More and 0.08% or Less and Ti: 0.002% or More and 0.12% or Less Nb and Ti contribute to increasing strength and improving bendability through a decrease in prior γ grain diameter. In addition, as a result of Nb and Ti forming carbides having a small grain diameter, since such carbides having a small grain diameter function as trap sites for trapping hydrogen so that there is a decrease in the amount of diffusible hydrogen in steel, there is an improvement in bendability. To realize such an effect, it is necessary that at least one of Nb and Ti be added in an amount of 0.002% or more, preferably 0.003% or more, or more preferably 0.005% or more. On the other hand, in the case where the Nb content or the Ti content is large, since there is an increase in the amounts of Nb-based precipitates having a large grain diameter such as NbN, Nb(C, N), and (Nb, Ti) (C, N) and Ti-based precipitates having a large grain diameter such as TiN, Ti(C, N), Ti(C, S), and TiS which remain undissolved when slab heating is performed in a hot rolling process, there is a deterioration in bendability. Therefore, the Nb content is set to be 0.08% or less, preferably 0.06% or less, or more preferably 0.04% or less. The Ti content is set to be 0.12% or less, preferably 0.10% or less, or more preferably 0.08% or less.

One or Both Selected from Cu: 0.005% or More and 1% or Less and Ni: 0.01% or More and 1% or Less Cu and Ni are effective for improving the corrosion resistance of an automobile in its practical service environment, and corrosion products thereof are effective for inhibiting hydrogen from entering a steel sheet as a result of coating the surface of the steel sheet. To realize such effects, it is necessary that the Cu content be 0.005% or more. It is necessary that the Ni content be 0.01% or more. To improve bendability, it is preferable that each of the Cu content and the Ni content be 0.05% or more or more preferably 0.08% or more. However, in the case where the Cu content or the Ni content is excessively large, since the occurrence of surface defects is brought about, there is a deterioration in coatability or phosphatability. Therefore, each of the Cu content and the Ni content is set to be 1% or less, preferably 0.8% or less, or more preferably 0.6% or less.

One, Two, or More Selected from Cr: 0.01% or More and 1.0% or Less, Mo: 0.01% or More and Less than 0.3%, V: 0.003% or More and 0.5% or Less, Zr: 0.005% or More and 0.20% or Less, and W: 0.005% or More and 0.20% or Less Cr, Mo, and V may be added to improve the hardenability of steel and to increase the effect of improving bendability due to a decrease in the grain diameter of tempered martensite. To realize such effects, it is necessary that each of the Cr content and the Mo content be 0.01% or more, preferably 0.02% or more, or more preferably 0.03% or more. It is necessary that the V content be 0.003% or more, preferably 0.005% or more, or more preferably 0.007% or more. However, in the case where the content of any one of these elements is excessively large, there is a deterioration in bendability due to an increase in the grain diameter of carbides. Therefore, the Cr content is set to be 1.0% or less, preferably 0.4% or less, or more preferably 0.2% or less. The Mo content is set to be less than 0.3%, preferably 0.2% or less, or more preferably 0.1% or less. The V content is set to be 0.5% or less, preferably 0.4% or less, or more preferably 0.3% or less.

Zr and W contribute to increasing strength and improving bendability through a decrease in prior γ grain diameter. To realize such an effect, it is necessary that each of the Zr content and the W content be 0.005% or more, preferably 0.006% or more, or more preferably 0.007% or more. However, in the case where the Zr content or the W content is excessively large, since there is an increase in the amount of precipitates having a large grain diameter which remain undissolved when slab heating is performed in a hot rolling process, there is a deterioration in bendability. Therefore, each of the Zr content and the W content is set to be 0.20% or less, preferably 0.15% or less, or more preferably 0.10% or less.

One, Two, or More Selected from Ca: 0.0002% or More and 0.0030% or Less, Ce: 0.0002% or More and 0.0030% or Less, La: 0.0002% or More and 0.0030% or Less, and Mg: 0.0002% or More and 0.0030% or Less Ca, Ce, and La contribute to improving bendability by fixing S in the form of sulfides and thereby functioning as trap sites for trapping hydrogen in steel so that there is a decrease in the amount of diffusible hydrogen in steel. To realize such an effect, it is necessary that each of the Ca content, the Ce content, and the La content be 0.0002% or more, preferably 0.0003% or more, or more preferably 0.0005% or more. On the other hand, in the case where the content of any one of these elements is large, there is a deterioration in bendability due to an increase in the grain diameter of sulfides. Therefore, each of the Ca content, Ce content, and the La content is set to be 0.0030% or less, preferably 0.0020% or less, or more preferably 0.0010% or less.

Mg contributes to improving bendability by fixing 0 in the form of MgO, which functions as a trap site for trapping hydrogen in steel so that there is a decrease in the amount of diffusible hydrogen in steel. To realize such an effect, the Mg content is set to be 0.0002% or more, preferably 0.0003% or more, or more preferably 0.0005% or more. On the other hand, in the case where the Mg content is large, since there is an increase in the grain diameter of MgO, there is a deterioration in bendability. Therefore, the Mg content is set to be 0.0030% or less, preferably 0.0020% or less, or more preferably 0.0010% or less.

One or Both Selected from Sb: 0.002% or More and 0.1% or Less and Sn: 0.002% or More and 0.1% or Less Sb and Sn inhibit a decrease in the amounts of C and B due to oxidation and nitriding of the surface layer of a steel sheet by inhibiting oxidation and nitriding of the surface layer of the steel sheet. In addition, as a result of a decrease in the amounts of C and B being inhibited, the formation of ferrite in the surface layer of the steel sheet is inhibited, which contributes to increasing strength. To realize such effects, it is necessary that each of the Sb content and Sn content be 0.002% or more, preferably 0.003% or more, or more preferably 0.004% or more. On the other hand, in the case where any one of the Sb content and Sn content is more than 0.1%, since Sb and Sn are segregated at prior γ grain boundaries, crack generation is promoted, which results in a deterioration in bendability. Therefore, each of the Sb content and the Sn content is set to be 0.1% or less, preferably 0.08% or less, or more preferably 0.06% or less.

Hereafter, the steel microstructure of the steel sheet according to aspects of the present invention will be described.

Total area fraction of one or both of bainite containing carbides having an average grain diameter of 50 nm or less and tempered martensite containing carbides having an average grain diameter of 50 nm or less: 90% or more To achieve both a high strength represented by a TS of 1320 MPa or more and excellent bendability, the total area fraction of bainite and/or tempered martensite containing carbides having an average grain diameter of 50 nm or less is set to be 90% or more in the whole microstructure. In the case where the total area fraction is less than 90%, since there is an increase in the amount of at least one of ferrite, retained γ (retained austenite), and martensite, there is a decrease in strength or yield ratio. Here, the total area fraction of tempered martensite and bainite described above may be 100% in the whole microstructure. In addition, a case where the area fraction of one of tempered martensite and bainite is within the range described above is satisfactory, and a case where the total area fraction of tempered martensite and bainite is within the range described above is satisfactory. Moreover, in the case where the average grain diameter of carbides inside the tempered martensite and bainite is more than 50 nm, since the carbides do not function as trap sites for trapping diffusible hydrogen in steel, and since the carbides become origins of fracture, there is a deterioration in bendability. In accordance with aspects of the present invention, the term "martensite" denotes a hard phase which is formed from austenite at a low temperature (equal to or lower than the martensite transformation temperature) and the term "tempered martensite" denotes a phase which is formed as a result of martensite being tempered when martensite is reheated. The term "bainite" denotes a hard phase which is formed from austenite at a relatively low temperature (equal to or higher than the martensite transformation temperature) and which is identified as a phase in which carbides having a small grain diameter are dispersed in ferrite having a needle- or plate-like shape. The term "average grain diameter" here denotes the average value of the grain diameters of all the carbides existing inside prior austenite in which bainite or tempered martensite is contained.

Note that examples of the remaining phases which are different from tempered martensite and bainite include ferrite, retained γ, and martensite, and it is acceptable that the total amount of the remaining phases be 10% or less in terms of area fraction. The total amount of the remaining phases described above may be 0% in terms of area fraction. In accordance with aspects of the present invention, the term "ferrite" denotes a phase which is formed through transformation from austenite at a comparatively high temperature and which composed of crystal grains having a BCC lattice structure.

Here, the area fraction of each of the phases in the steel microstructure is determined by using the method described in EXAMPLES below.

Total area fraction of one or both of bainite containing carbides having an average grain diameter of 50 nm or less and tempered martensite containing carbides having an average grain diameter of 50 nm or less: 80% or more in a region from the surface of the base steel sheet to a position located at ⅛ of the thickness of the base steel sheet Since a crack which is generated due to bending work is generated in the surface layer on the ridge line at the bending position of a coated steel sheet, the microstructure of the surface layer of the steel sheet is significantly important. In accordance with aspects of the present invention, as a result of utilizing carbides having a small grain diameter in the surface layer as trap sites for trapping hydrogen so that there is a decrease in the amount of diffusible hydrogen in steel existing in the vicinity of the surface layer of the steel sheet, there is an improvement in bendability. Therefore, it is possible to achieve the desired bendability by controlling the total area fraction of one or both of bainite containing carbides having an average grain diameter of 50 nm or less and tempered martensite containing carbides having an average grain diameter of 50 nm or less to be 80% or more in a region from the surface of the base steel sheet to a position located at ⅛ of the thickness of the base steel sheet. It is preferable that the total area fraction described above be 82% or more or more preferably 85% or more. There is no particular limitation on the upper limit of the total area fraction described above, the total area fraction may be 100%. In addition, in the region described above, a case where the area fraction of one of tempered martensite and bainite is within the range described above is satisfactory, and a case where the total area fraction of tempered martensite and bainite is within the range described above is satisfactory.

Amount of Diffusible Hydrogen in Steel: 0.20 Mass Ppm or Less

In accordance with aspects of the present invention, the term "the amount of diffusible hydrogen" denotes the amount of accumulated hydrogen which is released when heating is performed by using a thermal desorption analytical device at a heating rate of 200° C./hr for a measuring period of time corresponding to a temperature range from a heating start temperature (25° C.) to a temperature of 200° C. from an electrogalvanized steel sheet from which the coating layer has just been removed. In the case where the amount of diffusible hydrogen in steel is more than 0.20 mass ppm, there is a deterioration in bendability. Therefore, the amount of diffusible hydrogen in steel is set to be 0.20 mass ppm or less, preferably 0.15 mass ppm or less, or more preferably 0.10 mass ppm or less. There is no particular limitation on the lower limit of the amount of diffusible hydrogen, and the amount of diffusible hydrogen may be 0 mass ppm. Here, the amount of diffusible hydrogen in steel is determined by using the method described in EXAMPLES below. In accordance with aspects of the present invention, it is necessary that the amount of diffusible hydrogen in steel be 0.20 mass ppm or less before the steel sheet is subjected to forming work or welding. However, in the case of a product (member) which has been manufactured by performing forming work or welding on a steel sheet, when the amount of diffusible hydrogen in steel of a sample taken from such a product which has been used in a common practical service environment is determined and the amount of diffusible hydrogen in steel determined is 0.20 mass ppm or less, the amount of diffusible hydrogen in steel before forming work or welding is performed is also regarded as being 0.20 mass ppm or less.

Sum of Perimeters of Carbides Having an Average Grain Diameter of 0.1 μm or More and Inclusions: 50 μm/Mm$^2$ or Less (Preferable Condition)

In the case where inclusions or carbides having a large grain diameter are included, voids tend to be generated at the interface between the parent phase and the inclusions or the carbides. Since the frequency of void generation is proportional to the area of the interfaces between inclusions or carbides and the parent phase, decreasing the total area of the interfaces inhibits the generation of voids, thereby improving bendability. Therefore, it is preferable that the sum of perimeters (total perimeters) of carbides having an average grain diameter of 0.1 μm or more and inclusions be 50 μm/mm$^2$ or less (50 μm or less per 1 mm$^2$), more preferably 45 μm/mm$^2$ or less, or even more preferably 40 μm/mm$^2$ or less. Here, the term "average grain diameter" denotes the average value of a long side length and a short side length. The term "long side length" or "short side length" denotes the long axis length or short axis length of the equivalent ellipse of a grain. Here, the total perimeters of carbides having an average grain diameter of 0.1 μm or more and inclusions is determined by using the method described in EXAMPLES below.

The high-yield-ratio high-strength electrogalvanized steel sheet according to aspects of the present invention has an electrogalvanized coating layer formed on the surface of a steel sheet, which is the material of the high-yield-ratio high-strength electrogalvanized steel sheet, that is, a base steel sheet. There is no particular limitation on the kind of the electrogalvanized coating layer, and the kind of the electrogalvanized coating layer may be any one of, for example, a zinc coating layer (pure Zn) and a zinc-alloy coating layer (such as Zn—Ni, Zn—Fe, Zn—Mn, Zn—Cr, and Zn—Co). It is preferable that the coating weight of the electrogalvanized coating layer be 25 g/m$^2$ per side or more to improve corrosion resistance. In addition, it is preferable that the coating weight of the electrogalvanized coating layer be 50 g/m$^2$ per side or less to inhibit a deterioration in bendability. Although it is acceptable that the high-yield-ratio high-strength electrogalvanized steel sheet according to aspects of the present invention have an electrogalvanized coating layer on both sides or one side of the base steel sheet, it is preferable that the high-yield-ratio high-strength electrogalvanized steel sheet according to aspects of the present invention have an electrogalvanized coating layer on both sides of the base steel sheet when the high-yield-ratio high-strength electrogalvanized steel sheet is used for an automobile.

Hereafter, the properties of the high-yield-ratio high-strength electrogalvanized steel sheet according to aspects of the present invention will be described.

The high-yield-ratio high-strength electrogalvanized steel sheet according to aspects of the present invention has high strength. Specifically, the steel sheet has a tensile strength of 1320 MPa or more, preferably 1400 MPa or more, more preferably 1470 MPa or more, or even more preferably 1600 MPa or more. Here, although there is no particular limitation on the upper limit of the tensile strength, it is preferable that the tensile strength be 2200 MPa or less to easily balance the tensile strength with other properties. Here, the tensile strength is determined by using the method described in EXAMPLES below.

The high-yield-ratio high-strength electrogalvanized steel sheet according to aspects of the present invention has a high yield ratio. Specifically, the steel sheet has a yield ratio of 0.80 or more, preferably 0.81 or more, or more preferably 0.82 or more. Here, although there is no particular limitation on the upper limit of the yield ratio, it is preferable that the yield ratio be 0.95 or less to easily balance the yield ratio with other properties. In particular, it is possible to achieve a yield ratio of 0.82 or more and an a tensile strength of 1600 MPa or more by performing cooling to the cooling stop temperature in the annealing process at an average cooling rate equivalent to that of ultrarapid cooling such as water quenching under the conditions of a cooling stop temperature of 50° C. or lower and a holding temperature of 150° C. to 200° C. Here, the yield ratio is calculated from the tensile strength and the yield strength which are determined by using the method described in EXAMPLES below.

The high-yield-ratio high-strength electrogalvanized steel sheet according to aspects of the present invention has excellent bendability. Specifically, when the bending test described in EXAMPLES below is performed, the ratio of the bending radius (R) to the thickness (t), that is, R/t, is less than 3.5 in the case of a tensile strength of 1320 MPa or more and less than 1530 MPa, less than 4.0 in the case of a tensile strength of 1530 MPa or more and less than 1700 MPa, and less than 4.5 in the case of a tensile strength of 1700 MPa or more. It is preferable that R/t be 3.0 or less in the case of a tensile strength of 1320 MPa or more and less than 1530 MPa, 3.5 or less in the case of a tensile strength of 1530 MPa or more and less than 1700 MPa, and 4.0 or less in the case of a tensile strength of 1700 MPa or more.

Hereafter, the method for manufacturing the high-yield-ratio high-strength electrogalvanized steel sheet according to an embodiment of the present invention will be described.

The method for manufacturing the high-yield-ratio high-strength electrogalvanized steel sheet according to the embodiment of the present invention includes at least a hot rolling process, an annealing process, and an electroplating process. In addition, a cold rolling process may be included between the hot rolling process and the annealing process. In addition, a tempering process may be included after the electroplating process. Hereafter, each of the processes will be described. Here, the temperature described below denotes the temperature of the surface of a slab, a steel sheet, or the like.

Hot Rolling Process

The hot rolling process is a process of performing hot rolling on a steel slab having the chemical composition described above with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet.

The steel slab having the chemical composition described above is subjected to hot rolling. By controlling the slab heating temperature to be 1200° C. or higher, since it is possible to promote the dissolution of sulfides and inhibit the segregation of Mn, it is possible to decrease the amounts of the inclusions and the carbides having a large grain diameter described above, which results in an improvement in bendability. Therefore, the slab heating temperature is set to be 1200° C. or higher, preferably 1230° C. or higher, or more preferably 1250° C. or higher. Although there is no particular limitation on the upper limit of the slab heating temperature, it is preferable that the slab heating temperature be 1400° C. or less. In addition, for example, it is acceptable that the heating rate for slab heating be 5° C./min to 15° C./min and that the slab soaking time be 30 minutes to 100 minutes.

It is preferable that the rolling time in a temperature range from a temperature of 1150° C. to the finishing delivery temperature in the hot rolling process be 200 seconds or less. By decreasing the rolling time, it is possible to inhibit the formation of carbonitrides having a large grain diameter and inclusions. In addition, even if inclusions are formed, it is possible to inhibit an increase in the grain diameter of the inclusions. Therefore, by decreasing the rolling time, it is possible to contribute to improving bendability. As described above, it is preferable that the rolling time in a temperature range from a temperature of 1150° C. to the finishing delivery temperature be 200 seconds or less, more preferably 180 seconds or less, or even more preferably 160 seconds or less. Although there is no particular limitation on the lower limit of the rolling time, it is preferable that the rolling time be 40 seconds or more.

It is necessary that the finishing delivery temperature be 840° C. or higher. In the case where the finishing delivery temperature is lower than 840° C., since there is an increase in the time required for reaching the finishing delivery temperature, there is a deterioration in bendability due to the formation of carbides having a large grain diameter and inclusions, and there may be a deterioration in the internal quality of the steel sheet. Therefore, it is necessary that the finishing delivery temperature be 840° C. or higher or preferably 860° C. or higher. On the other hand, although there is no particular limitation on the upper limit of the finishing delivery temperature, cooling to the coiling temperature is difficult in the case of an excessively high finishing delivery temperature. Therefore, it is preferable that the finishing delivery temperature be 950° C. or lower, or more preferably 920° C. or lower.

After finish rolling has been performed, cooling is performed at an average cooling rate of 40° C./sec or higher in a temperature range from the finishing delivery temperature to a temperature of 700° C. In the case where the cooling rate is low, since inclusions are formed, and since there is an increase in the grain diameter of the formed inclusions, there is a deterioration in bendability. In addition, since there is a decrease in the area fraction of martensite and bainite, which contain carbides, in the surface layer of the steel due to the decarburization of the surface layer, there is a decrease in the amount of carbides having a small grain diameter, which function as trap sites for trapping hydrogen in the vicinity of the surface layer, which makes it difficult to achieve the desired bendability. Therefore, after finish rolling has been performed, the average cooling rate in a temperature range from the finishing delivery temperature to a temperature of 700° C. is set to be 40° C./sec or higher or preferably 50° C./sec or higher. Although there is no particular limitation on the upper limit of the average cooling rate, it is preferable that upper limit of the average cooling rate be about 250° C./sec. In addition, the primary cooling stop temperature is set to be 700° C. or lower. In the case where the primary cooling stop temperature is higher than 700° C., since carbides tend to be formed in a temperature range higher than 700° C., and since there is an increase in the grain diameter of the formed carbides, there is a deterioration in bendability. Although there is no particular limitation on the lower limit of the primary cooling stop temperature, there is a decrease in the effect of inhibiting the formation of carbides due to rapid cooling in the case where the primary cooling stop temperature is 650° C. or lower. Therefore, it is preferable that the primary cooling stop temperature be higher than 650° C.

Subsequently, cooling is performed to a coiling temperature of 630° C. or lower in such a manner that cooling is performed at an average cooling rate of 2° C./sec or higher in a temperature range from the primary cooling stop temperature to a temperature of 650° C. In the case where the cooling rate to a temperature of 650° C. is low, since inclusions are formed, and since there is an increase in the grain diameter of the formed inclusions, there is a deterioration in bendability. In addition, since there is a decrease in the area fraction of martensite and bainite, which contain carbides, in the surface layer of the steel due to the decarburization of the surface layer, there is a decrease in the amount of carbides having a small grain diameter, which function as trap sites for trapping hydrogen in the vicinity of the surface layer, which makes it difficult to achieve the desired bendability. Therefore, as described above, after cooling has been performed to the primary cooling stop temperature of 700° C. or lower in such a manner that cooling is performed at an average cooling rate of 40° C./sec or higher in a temperature range higher than 700° C., the average cooling rate from the primary cooling stop temperature to a temperature of 650° C. is set to be 2° C./sec or more, preferably 3° C./sec or more, or more preferably 5° C./sec. Although there is no particular limitation on the average cooling rate from a temperature of 650° C. to the coiling temperature, it is preferable that the average cooling rate be 0.1° C./sec or higher and 100° C./sec or lower.

Here, the average cooling rate is calculated by using the expression (cooling start temperature−cooling stop temperature)/(cooling time in a temperature range from cooling start temperature to cooling stop temperature), unless otherwise noted.

The coiling temperature is set to be 630° C. or lower. In the case where the coiling temperature is higher than 630° C., since there is a risk of decarburization occurring on the surface of the base steel sheet, a difference in microstructure is produced between the inside and surface of the steel sheet, which results in a variation in alloy concentrations. In addition, since ferrite is formed due to decarburization in the surface layer, there is a decrease in tensile strength, yield ratio, or both. Therefore, the coiling temperature is set to be 630° C. or lower, or preferably 600° C. or lower. Although there is no particular limitation on the lower limit of the coiling temperature, it is preferable that the coiling temperature be 500° C. or higher to inhibit a deterioration in cold rolling capability in the case where cold rolling is performed.

The hot-rolled steel sheet after coiling has been performed may be subjected to pickling. There is no particular limitation on the conditions applied for pickling. Here, pickling need not be performed on the hot-rolled steel sheet.

Cold Rolling Process

The cold rolling process is a process of performing cold rolling on the hot-rolled steel sheet obtained in the hot rolling process. Although there is no particular limitation on the rolling reduction ratio when cold rolling is performed, there is a risk of a deterioration in the flatness of the surface and risk of a variation in microstructure in the case where the rolling reduction ratio is less than 20%. Therefore, it is preferable that the rolling reduction ratio be 20% or more. Here, the cold rolling process is not an indispensable process, and the cold rolling process may be omitted as long as the steel microstructure and the mechanical properties satisfy the requirements according to aspects of the present invention.

Annealing Process

The annealing process is a process of holding (soaking) the cold-rolled steel sheet or the hot-rolled steel sheet at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds.

The hot-rolled steel sheet or the cold-rolled steel sheet is heated to the annealing temperature equal to or higher than the $A_{C3}$ temperature and soaked thereafter. In the case where the annealing temperature is lower than the $A_{C3}$ temperature, since there is an excessive increase in the amount of ferrite, it is difficult to obtain a steel sheet having a YR of 0.80 or more. Therefore, it is necessary that the annealing temperature be equal to or higher than the $A_{C3}$ temperature, preferably equal to or higher than the $A_{C3}$ temperature+10° C. Although there is no particular limitation on the upper limit of the annealing temperature, it is preferable that the annealing temperature be 910° C. or lower to inhibit an increase in austenite grain diameter and to thereby inhibit a deterioration in bendability.

Here, the $A_{C3}$ temperature (° C.) is calculated by using the equation below. In addition, in the equation below, under the assumption that symbol M is used instead of the atomic symbol of some element, symbol (% M) denotes the content (mass %) of the element denoted by symbol M.

$$A_{C3}=910-203(\%\ C)^{1/2}+45(\%\ Si)-30(\%\ Mn)-20(\%\ Cu)-15(\%\ Ni)+11(\%\ Cr)+32(\%\ Mo)+104(\%\ V)+400(\%\ Ti)+460(\%\ Al)$$

The holding time at the annealing temperature (annealing holding time) is set to be 30 seconds or more. In the case where the annealing holding time is less than 30 seconds, since the dissolution of carbides or austenite transformation does not sufficiently progress, there is an increase in the grain diameter of the retained carbides in a subsequent heat treatment, which results in a deterioration in bendability. Therefore, the annealing holding time is set to be 30 seconds or more or preferably 35 seconds or more. Although there is no particular limitation on the upper limit of the annealing holding time, it is preferable that the annealing holding time be 900 seconds or less to inhibit an increase in austenite grain diameter and to thereby inhibit a deterioration in bendability.

After holding at the annealing temperature has been performed, cooling is performed from a cooling start temperature of 680° C. or higher to a cooling stop temperature of 260° C. or lower in such a manner that cooling is performed at an average cooling rate of 70° C./sec or higher in a temperature range of 680° C. to 260° C. In the case where the upper limit of the temperature range, in which the average cooling rate is specified as described above, is lower than 680° C., it is difficult to obtain a steel sheet having a YR of 0.80 or more due to the formation of ferrite. Therefore, the upper limit of the temperature range, in which the average cooling rate is specified as described above, is set to be 680° C. or higher or preferably 700° C. or higher. In the case where the lower limit of the temperature range, in which the average cooling rate is specified as described above, is higher than 260° C., since tempering does not sufficiently progress, martensite and retained austenite are formed in the final microstructure, which results in a decrease in yield ratio. In addition, since hydrogen in steel is not released into the atmosphere, hydrogen remains in steel, which results in a deterioration in bendability. Therefore, the lower limit of the temperature range, in which the average cooling rate is specified as described above, is set to be 260° C. or lower or preferably 240° C. or lower. In the case where the average cooling rate described above is lower than 70° C./sec, since upper bainite and lower bainite tend to be formed in large amounts, martensite and retained austenite are formed in the final microstructure, which results in a decrease in yield ratio. Therefore, the average cooling rate described above is set to be 70° C./sec or higher, preferably 100° C./sec or higher, or more preferably 500° C./sec or higher. Although there is no particular limitation on the upper limit of the average cooling rate described above, the common upper limit is about 2000° C./sec. Here, there is no particular limitation on the average cooling rate in a temperature range from the annealing temperature to a temperature of 680° C. or the average cooling rate in a temperature range from a temperature of 260° C. to the cooling stop temperature (in the case where the cooling stop temperature is lower than 260° C.)

After reheating treatment is performed as needed (although reheating is necessary in the case where the cooling stop temperature is lower than 150° C., reheating may be performed, even in the case where the cooling stop temperature is 150° C. or higher), holding is performed at a holding temperature range of 150° C. to 260° C. for 20 seconds to 1500 seconds. Carbides distributed inside tempered martensite and/or bainite are carbides which are formed when holding is performed in a low temperature range after quenching has been performed and which function as trap sites for trapping hydrogen, thereby preventing a deterioration in bendability. To achieve good delayed fracturing resistance, it is preferable that holding be performed for 20 seconds to 1500 seconds, after quenching to near room temperature (5° C. to 40° C.) followed by reheating to a temperature of 150° C. to 260° C. or that holding be performed for 20 seconds to 1500 seconds after rapid cooling has been performed to a cooling stop temperature of 150° C. to 260° C. In the case where the holding temperature is lower than 150° C. or the holding time is less than 20 seconds, since carbides are not formed in a sufficient amount inside tempered martensite and/or bainite, there is a decrease in the amount of trap sites for trapping diffusible hydrogen in steel, which results in a deterioration in bendability due to an increase in the amount of diffusible hydrogen in steel. On the other hand, in the case where the holding temperature is higher than 260° C. or the holding time is more than 1500 seconds, since there is an increase in the grain diameter of carbides inside prior γ grains and at prior γ grain boundaries, the average grain diameter of the carbide become more than 50 nm, which conversely results in a deterioration in bendability. Here, it is preferable that the holding time be 120 seconds or more and 1200 seconds or less. Here, there is no particular limitation on the conditions applied for reheating. In addition, in the case where the cooling stop temperature is lower than 150° C., it is necessary to perform reheating.

Electroplating Process

The electroplating process is an electrogalvanizing process.

The electrogalvanizing process is a process in which the steel sheet after the annealing process is cooled to room temperature and subjected to an electrogalvanizing treatment. Although there is no particular limitation on the average cooling rate for cooling from a temperature range of 150° C. to 260° C. at which holding is performed to room temperature (10° C. to 30° C.), it is preferable that cooling be performed at an average cooling rate of 1° C./sec or more to a temperature of 50° C. After cooling has been performed to room temperature, an electrogalvanizing treatment is performed. To inhibit hydrogen from entering steel and to thereby control the amount of diffusible hydrogen in steel to be 0.20 mass ppm or less, the electrogalvanizing time is important. In the case where the electrogalvanizing time is more than 300 seconds, since the period of time for which the steel sheet is dipped in acid is long, there is an increase in the amount of diffusible hydrogen in steel to more than 0.20 mass ppm, which results in a deterioration in bendability. Therefore, the electrogalvanizing time is set to be 300 seconds or less, preferably 250 seconds or less, or more preferably 200 seconds or less. In addition, although there is no particular limitation on the lower limit of the electrogalvanizing time, it is preferable that the electrogalvanizing time be 30 seconds or more. There is no particular limitation on the conditions other than the electrogalvanizing time such as current efficiency as long as it is possible to achieve a sufficient coating weight.

Tempering Process

The tempering process is a process which is performed to release hydrogen from inside steel, in which it is possible to decrease the amount of diffusible hydrogen in steel by holding the steel sheet in a temperature range of 250° C. or lower for a holding time t which satisfies relational expression (1) below, and which can thereby be utilized to further improve bendability. In the case where the tempering temperature is higher than 250° C. or the holding time does not satisfy the relational expression below, since there is an increase in the grain diameter of carbides in bainite or tempered martensite, there may be a deterioration in bendability. Therefore, it is preferable that the holding temperature be 250° C. or lower, preferably 200° C. or lower, or more preferably 150° C. or lower.

$$(T+273)(\log t+4)\leq 2700 \quad (1)$$

Here, in relational expression (1), T denotes the holding temperature (° C.) in the tempering process and t denotes the holding time (sec) in the tempering process.

Note that the hot-rolled steel sheet after the hot rolling process may be subjected to a heat treatment to soften the microstructure, and the steel sheet after the electroplating process may be subjected to skin pass rolling to adjust the shape.

According to the manufacturing method according to the present embodiment described above, as a result of controlling the manufacturing conditions before the electrogalvanizing treatment and the electrogalvanizing conditions, since there is a decrease in the amount of diffusible hydrogen in steel, it is possible to obtain a high-yield-ratio high-strength electrogalvanized steel sheet having excellent bendability.

EXAMPLES

The present invention will be specifically described with reference to examples.

1. Manufacturing Steel Sheet for Evaluation

After molten steels having the chemical compositions given in Table 1 and a balance of Fe and inevitable impurities had been prepared by using a vacuum melting furnace, slabbing rolling was performed to obtain rolled slabs having a thickness of 27 mm. The obtained slabs were subjected to hot rolling so as to be made into hot-rolled steel sheets having a thickness of 4.0 mm. Subsequently, samples to be cold-rolled were prepared by grinding the hot-rolled steel sheet to obtain a thickness of 3.2 mm, and the ground samples were subjected to cold rolling with the rolling reduction ratios given in Table 2-1 through Table 2-4 to obtain cold-rolled steel sheets having a thickness of 2.72 mm to 0.96 mm. Here, in Table 2-3, the samples whose rolling reduction ratios for cold rolling are not given were not subjected to cold rolling. Subsequently, the hot-rolled steel sheets and the cold-rolled steel sheets obtained as described above were subjected to annealing and an electrogalvanizing treatment under the conditions given in Table 2-1 through Table 2-4 to obtain electrogalvanized steel sheets. Here, the blank in Table 1 indicates that the corresponding element was not intentionally added, and there may be a case where the content of such an element was 0 mass % or a case where such an element was contained as an inevitable impurity. In addition, some of the samples were subjected to a tempering treatment to release hydrogen. Here, in Table 2-1 through Table 2-4, the blank in the column "Tempering Condition" indicates that the corresponding sample was not subjected to a tempering treatment.

When the above-described steel sheets for evaluation were manufactured, to manufacture the electrogalvanized steel sheets, the electrogalvanizing solution was prepared by adding zinc sulfate heptahydrate to pure water in an amount of 440 g/L and by further adding sulfuric acid to achieve a pH of 2.0 in the case of a pure Zn coating layer. In the case of a Zn—Ni coating layer, the electrogalvanizing solution was prepared by adding zinc sulfate heptahydrate in an amount of 150 g/L and nickel sulfate hexahydrate in an amount of 350 g/L to pure water and by further adding sulfuric acid to achieve a pH of 1.3. In the case of a Zn—Fe coating layer, the electrogalvanizing solution was prepared by adding zinc sulfate heptahydrate to pure water in an amount of 50 g/L and Fe sulfate in an amount of 350 g/L to pure water and by further adding sulfuric acid to achieve a pH of 2.0. In addition, the alloy compositions of the coating layers formed by using the three solutions were respectively 100% Zn, Zn-13% Ni, and Zn-46% Fe as determined by performing ICP analysis. The coating weight of the electrogalvanized coating layer was 25 g/m$^2$ to 50 g/m$^2$ per side. Specifically, the coating weight was 33 g/m$^2$ per side in the case of the 100% Zn coating layer, 27 g/m$^2$ per side in the case of the Zn-13% Ni coating layer, and 27 g/m$^2$ per side in the case of the Zn-46% Fe coating layer. Here, such electrogalvanized coating layers were formed on both sides of the steel sheets.

TABLE 1

| Steel | Chemical Composition (mass %) | | | | | | | | | | | | |
|---|---|---|---|---|---|---|---|---|---|---|---|---|---|
| Grade | C | Si | Mn | P | S | Al | N | B | Nb | Ti | Cu | Ni | Cr |
| A | 0.30 | 0.20 | 1.20 | 0.007 | 0.0008 | 0.05 | 0.0021 | | | | | | |
| B | 0.16 | 0.20 | 1.20 | 0.008 | 0.0003 | 0.07 | 0.0048 | | | | | | |
| C | 0.19 | 0.20 | 1.20 | 0.008 | 0.0005 | 0.08 | 0.0021 | | | | | | |
| D | 0.39 | 0.20 | 1.20 | 0.018 | 0.0002 | 0.02 | 0.0043 | | | | | | |
| E | 0.27 | 0.02 | 1.30 | 0.010 | 0.0010 | 0.08 | 0.0043 | | | | | | |
| F | 0.26 | 1.30 | 1.30 | 0.010 | 0.0010 | 0.05 | 0.0058 | | | | | | |
| G | 0.28 | 1.60 | 1.10 | 0.007 | 0.0004 | 0.04 | 0.0014 | | | | | | |
| H | 0.22 | 0.03 | 0.85 | 0.007 | 0.0010 | 0.08 | 0.0034 | | | | | | |
| I | 0.21 | 0.12 | 0.95 | 0.006 | 0.0007 | 0.10 | 0.0046 | | | | | | |
| J | 0.28 | 0.40 | 1.50 | 0.025 | 0.0002 | 0.09 | 0.0028 | | | | | | |
| K | 0.27 | 0.38 | 1.60 | 0.009 | 0.0009 | 0.03 | 0.0031 | | | | | | |
| L | 0.22 | 0.01 | 1.30 | 0.016 | 0.0004 | 0.04 | 0.0028 | 0.0020 | | | | | |
| M | 0.23 | 0.07 | 1.00 | 0.005 | 0.0004 | 0.05 | 0.0015 | 0.0032 | | | | | |
| N | 0.22 | 0.21 | 1.20 | 0.006 | 0.0010 | 0.07 | 0.0053 | 0.0004 | | | | | |
| O | 0.23 | 0.30 | 1.21 | 0.038 | 0.0006 | 0.05 | 0.0040 | | 0.0150 | | | | |
| P | 0.32 | 0.09 | 1.16 | 0.006 | 0.0002 | 0.06 | 0.0027 | | 0.0700 | | | | |
| Q | 0.24 | 0.75 | 1.16 | 0.009 | 0.0002 | 0.06 | 0.0051 | | 0.0025 | | | | |
| R | 0.20 | 0.11 | 1.35 | 0.007 | 0.0004 | 0.04 | 0.0051 | | | 0.017 | | | |
| S | 0.25 | 0.10 | 1.20 | 0.006 | 0.0003 | 0.04 | 0.0037 | | | 0.090 | | | |
| T | 0.36 | 0.04 | 1.25 | 0.017 | 0.0005 | 0.03 | 0.0019 | | | 0.0025 | | | |
| U | 0.28 | 0.20 | 1.25 | 0.009 | 0.0003 | 0.10 | 0.0060 | | | | 0.15 | | |
| V | 0.28 | 0.60 | 1.10 | 0.025 | 0.0010 | 0.10 | 0.0020 | | | | 0.90 | | |
| W | 0.26 | 0.12 | 1.16 | 0.008 | 0.0010 | 0.07 | 0.0020 | | | | 0.02 | | |
| X | 0.22 | 0.35 | 1.20 | 0.009 | 0.0001 | 0.06 | 0.0043 | 0.0025 | | 0.015 | | 0.12 | |
| Y | 0.23 | 1.10 | 1.20 | 0.009 | 0.0009 | 0.04 | 0.0029 | | 0.0130 | | | | 0.05 |
| Z | 0.20 | 1.30 | 1.30 | 0.009 | 0.0007 | 0.03 | 0.0039 | | | | 0.13 | | 0.03 |
| AA | 0.18 | 0.10 | 1.30 | 0.045 | 0.0010 | 0.03 | 0.0033 | | | | | | |
| AB | 0.17 | 0.10 | 1.25 | 0.007 | 0.0007 | 0.06 | 0.0027 | | | | | | |
| AC | 0.42 | 1.10 | 1.20 | 0.019 | 0.0002 | 0.04 | 0.0021 | | | | | | |
| AD | 0.12 | 1.20 | 1.20 | 0.006 | 0.0002 | 0.08 | 0.0055 | | | | | | |
| AE | 0.21 | 2.40 | 1.05 | 0.008 | 0.0010 | 0.02 | 0.0028 | | | | | | |
| AF | 0.22 | 0.12 | 1.90 | 0.026 | 0.0006 | 0.07 | 0.0024 | | | | | | |
| AG | 0.26 | 0.16 | 0.05 | 0.008 | 0.0007 | 0.06 | 0.0010 | | | | | | |
| AH | 0.28 | 0.84 | 1.20 | 0.070 | 0.0004 | 0.07 | 0.0058 | | | | | | |
| AI | 0.26 | 0.07 | 1.32 | 0.007 | 0.0080 | 0.06 | 0.0028 | | | | | | |
| AJ | 0.25 | 0.11 | 1.31 | 0.006 | 0.0003 | 0.25 | 0.0021 | | | | | | |
| AK | 0.21 | 0.05 | 1.28 | 0.018 | 0.0008 | 0.07 | 0.0150 | | | | | | |
| AL | 0.18 | 0.01 | 1.50 | 0.009 | 0.0005 | 0.08 | 0.0015 | 0.0040 | | | | | |
| AM | 0.15 | 0.04 | 1.40 | 0.009 | 0.0002 | 0.05 | 0.0057 | | 0.1000 | | | | |
| AN | 0.14 | 0.15 | 1.30 | 0.006 | 0.0009 | 0.07 | 0.0054 | | | 0.140 | | | |

| Steel | Chemical Composition (mass %) | | | | | | | | | | $A_{c3}$ |
|---|---|---|---|---|---|---|---|---|---|---|---|
| Grade | Mo | V | Zr | W | Ca | Ce | La | Mg | Sb | Sn | Temperature |
| A | | | | | | | | | | | 795 |
| B | | | | | | | | | | | 833 |
| C | | | | | | | | | | | 831 |
| D | | | | | | | | | | | 766 |
| E | | | | | | | | | | | 802 |
| F | | | | | | | | | | | 849 |
| G | | | | | | | | | | | 858 |
| H | | | | | | | | | | | 827 |
| I | | | | | | | | | | | 838 |
| J | | | | | | | | | | | 818 |
| K | | | | | | | | | | | 786 |
| L | | | | | | | | | | | 794 |
| M | | | | | | | | | | | 809 |

TABLE 1-continued

| | | | | | | | | | | | |
|---|---|---|---|---|---|---|---|---|---|---|---|
| N | | | | | | | | | | | 819 |
| O | | | | | | | | | | | 813 |
| P | | | | | | | | | | | 793 |
| Q | | | | | | | | | | | 838 |
| R | | | | | | | | | | | 808 |
| S | | | | | | | | | | | 831 |
| T | | | | | | | | | | | 769 |
| U | | | | | | | | | | | 815 |
| V | | | | | | | | | | | 823 |
| W | | | | | | | | | | | 808 |
| X | | | | | | | | | | | 825 |
| Y | 0.05 | | | | | | | | | | 848 |
| Z | | 0.012 | | | | | | | | | 853 |
| AA | | | 0.009 | 0.01 | 0.0008 | 0.0009 | 0.0006 | 0.0005 | | | 805 |
| AB | | | | | | | | | 0.007 | 0.004 | 821 |
| AC | | | | | | | | | | | 808 |
| AD | | | | | | | | | | | 893 |
| AE | | | | | | | | | | | 904 |
| AF | | | | | | | | | | | 795 |
| AG | | | | | | | | | | | 839 |
| AH | | | | | | | | | | | 836 |
| AI | | | | | | | | | | | 797 |
| AJ | | | | | | | | | | | 889 |
| AK | | | | | | | | | | | 813 |
| AL | | | | | | | | | | | 815 |
| AM | | | | | | | | | | | 816 |
| AN | | | | | | | | | | | 891 |

Underlined portions indicate items out of the range according to aspects of the present invention.

TABLE 2-1

| | | Hot Rolling | | | | | | Cold | | | |
|---|---|---|---|---|---|---|---|---|---|---|---|
| | | | | | | | | Rolling | Annealing Condition | | |
| No. | Steel Grade | Slab Heating Temperature ° C. | Rolling Time*1 sec | Finishing Delivery Temperature ° C. | Average Cooling Rate to 700° C. *2 ° C./s | Average Cooling Rate to 650° C. *3 ° C./s | Coiling Temperature ° C. | Rolling Reduction Ratio % | Annealing Temperature ° C. | Annealing Holding Time sec | Cooling Start Temperature ° C. |
| 1 | A | 1250 | 74 | 880 | 232 | 11 | 550 | 56 | 904 | 35 | 831 |
| 2 | | 1250 | 225 | 880 | 245 | 13 | 550 | 56 | 867 | 35 | 801 |
| 3 | | 1250 | 54 | 880 | 225 | 12 | 550 | 56 | 891 | 35 | 709 |
| 4 | | 1250 | 85 | 880 | 246 | 14 | 550 | 56 | 860 | 35 | 845 |
| 5 | | 1250 | 66 | 880 | 248 | 20 | 550 | 56 | 873 | 35 | 748 |
| 6 | | 1250 | 90 | 880 | 247 | 18 | 550 | 56 | 887 | 35 | 697 |
| 7 | | 1250 | 67 | 880 | 239 | 13 | 550 | 56 | 910 | 35 | 891 |
| 8 | | 1250 | 66 | 880 | 251 | 11 | 550 | 56 | 864 | 35 | 719 |
| 9 | B | 1180 | 71 | 880 | 235 | 13 | 550 | 56 | 887 | 35 | 717 |
| 10 | | 1220 | 74 | 880 | 237 | 15 | 550 | 56 | 902 | 35 | 900 |
| 11 | | 1235 | 69 | 880 | 241 | 17 | 550 | 56 | 896 | 35 | 887 |
| 12 | | 1250 | 71 | 880 | 242 | 14 | 550 | 56 | 890 | 35 | 761 |
| 13 | C | 1250 | 93 | 830 | 239 | 18 | 550 | 56 | 863 | 35 | 830 |
| 14 | | 1250 | 83 | 850 | 242 | 15 | 550 | 56 | 904 | 35 | 858 |
| 15 | | 1250 | 55 | 880 | 250 | 16 | 550 | 56 | 894 | 35 | 894 |
| 16 | | 1250 | 54 | 940 | 247 | 14 | 550 | 56 | 862 | 35 | 767 |
| 17 | | 1250 | 140 | 960 | 250 | 12 | 550 | 56 | 894 | 35 | 815 |
| 18 | D | 1250 | 60 | 880 | 100 | 11 | 550 | 56 | 872 | 35 | 827 |
| 19 | | 1250 | 88 | 880 | 40 | 18 | 550 | 56 | 880 | 35 | 819 |
| 20 | | 1250 | 51 | 880 | 20 | 14 | 550 | 56 | 884 | 35 | 779 |
| 21 | | 1250 | 51 | 880 | 228 | 1 | 550 | 56 | 898 | 35 | 803 |
| 22 | E | 1250 | 160 | 880 | 229 | 15 | 550 | 56 | 867 | 35 | 731 |
| 23 | | 1250 | 59 | 880 | 231 | 17 | 550 | 56 | 883 | 35 | 860 |
| 24 | | 1250 | 93 | 880 | 234 | 14 | 550 | 56 | 899 | 35 | 714 |
| 26 | | 1250 | 58 | 880 | 229 | 13 | 550 | 56 | 880 | 35 | 730 |
| 27 | | 1250 | 230 | 880 | 230 | 12 | 550 | 56 | 878 | 35 | 702 |
| 28 | | 1250 | 55 | 880 | 231 | 16 | 550 | 56 | 909 | 35 | 820 |
| 29 | | 1250 | 62 | 880 | 230 | 15 | 550 | 56 | 890 | 35 | 740 |
| 30 | | 1250 | 56 | 880 | 234 | 18 | 550 | 56 | 909 | 35 | 890 |
| 31 | | 1250 | 63 | 880 | 238 | 17 | 550 | 56 | 873 | 35 | 869 |
| 32 | | 1250 | 99 | 880 | 237 | 14 | 550 | 56 | 880 | 35 | 750 |

TABLE 2-1-continued

| No. | Annealing Condition: Average Cooling Rate*4 ° C./s | Annealing Condition: Cooling Stop Temperature ° C. | Annealing Condition: Holding Temperature ° C. | Annealing Condition: Holding Time sec | Electrogalvanizing Condition: Kind of Coating Layer | Electrogalvanizing Condition: Electrogalvanizing Time sec | Tempering Condition: Holding Temperature ° C. | Tempering Condition: Holding Time sec | |
|---|---|---|---|---|---|---|---|---|---|
| 1 | 1807 | 25 | 200 | 700 | Zn—Ni | 50 | | | Example |
| 2 | 1615 | 25 | 200 | 900 | Zn—Ni | 100 | | | Example |
| 3 | 1816 | 50 | 200 | 800 | Zn—Ni | 150 | | | Example |
| 4 | 1594 | 300 | 200 | 700 | Zn—Ni | 200 | | | Comparative Example |
| 5 | 1525 | 25 | 200 | 600 | Zn—Ni | 230 | 250 | 10 | Example |
| 6 | 1618 | 25 | 200 | 800 | Zn—Ni | 280 | 80 | 3600 | Example |
| 7 | 1772 | 25 | 200 | 800 | Zn—Ni | 300 | | | Example |
| 8 | 1782 | 25 | 200 | 800 | Zn—Ni | 340 | | | Comparative Example |
| 9 | 1524 | 50 | 200 | 900 | Zn—Ni | 160 | | | Comparative Example |
| 10 | 1938 | 50 | 200 | 600 | Zn—Ni | 110 | | | Example |
| 11 | 1669 | 100 | 200 | 800 | Zn—Ni | 110 | 200 | 30 | Example |
| 12 | 1788 | 100 | 200 | 800 | Zn—Ni | 180 | 150 | 180 | Example |
| 13 | 1741 | 25 | 200 | 800 | Zn—Ni | 130 | | | Comparative Example |
| 14 | 1535 | 25 | 200 | 700 | Zn—Ni | 130 | | | Example |
| 15 | 1994 | 25 | 200 | 900 | Zn—Ni | 130 | | | Example |
| 16 | 1657 | 50 | 200 | 600 | Zn—Ni | 110 | 100 | 1200 | Example |
| 17 | 1932 | 50 | 200 | 800 | Zn—Ni | 120 | 80 | 180 | Example |
| 18 | 1637 | 25 | 200 | 600 | Zn—Ni | 190 | | | Example |
| 19 | 1585 | 25 | 200 | 800 | Zn—Ni | 200 | | | Example |
| 20 | 1909 | 100 | 200 | 800 | Zn—Ni | 170 | | | Comparative Example |
| 21 | 1685 | 100 | 200 | 800 | Zn—Ni | 100 | | | Comparative Example |
| 22 | 1880 | 300 | 200 | 900 | Zn—Ni | 110 | | | Comparative Example |
| 23 | 1648 | 250 | 250 | 900 | Zn—Ni | 170 | | | Example |
| 24 | 1810 | 200 | 250 | 900 | Zn—Ni | 100 | | | Example |
| 26 | 2100 | 200 | 150 | 900 | Zn—Ni | 180 | 100 | 120 | Example |
| 27 | 1721 | 150 | 200 | 900 | Zn—Ni | 130 | | | Example |
| 28 | 1765 | 150 | 150 | 900 | Zn—Ni | 190 | | | Example |
| 29 | 2050 | 150 | 100 | 900 | Zn—Ni | 170 | | | Comparative Example |
| 30 | 1657 | 100 | 200 | 900 | Zn—Ni | 190 | | | Example |
| 31 | 1789 | 100 | 150 | 900 | Zn—Ni | 150 | | | Example |
| 32 | 1950 | 100 | 100 | 900 | Zn—Ni | 180 | | | Comparative Example |

*1 Rolling time in a temperature range from a temperature of 1150° C. to the finishing delivery temperature

*2 Average cooling rate from the finishing delivery temperature to a temperature of 700° C.

*3 Average cooling rate in a temperature range of 700° C. (primary cooling stop temperature) to 650° C.

*4 Average cooling rate in a temperature range of 680° C. to 260° C.

Underlined portions indicate items out of the range according to aspects of the present invention.

TABLE 2-2

| No. | Steel Grade | Hot Rolling: Slab Heating Temperature ° C. | Hot Rolling: Rolling Time*1 sec | Hot Rolling: Finishing Delivery Temperature ° C. | Hot Rolling: Average Cooling Rate to 700° C. *2 ° C./s | Hot Rolling: Average Cooling Rate to 650° C *3 ° C./s | Hot Rolling: Coiling Temperature ° C. | Cold Rolling: Rolling Reduction Ratio % | Annealing Condition: Annealing Temperature ° C. | Annealing Condition: Annealing Holding Time sec | Annealing Condition: Cooling Start Temperature ° C. |
|---|---|---|---|---|---|---|---|---|---|---|---|
| 33 | F | 1250 | 100 | 880 | 241 | 11 | 700 | 56 | 894 | 35 | 806 |
| 34 | | 1250 | 51 | 880 | 235 | 12 | 630 | 56 | 882 | 35 | 835 |
| 35 | | 1250 | 66 | 880 | 236 | 13 | 550 | 56 | 905 | 35 | 830 |
| 36 | G | 1250 | 55 | 880 | 238 | 15 | 550 | 15 | 906 | 35 | 807 |
| 37 | | 1250 | 78 | 880 | 244 | 16 | 550 | 56 | 885 | 35 | 763 |
| 38 | | 1250 | 53 | 880 | 241 | 18 | 550 | 70 | 882 | 35 | 758 |
| 39 | H | 1250 | 52 | 880 | 237 | 19 | 550 | 56 | 815 | 35 | 733 |
| 40 | | 1250 | 82 | 880 | 229 | 14 | 550 | 56 | 850 | 35 | 772 |
| 41 | | 1250 | 57 | 880 | 235 | 15 | 550 | 56 | 870 | 35 | 829 |
| 42 | I | 1250 | 85 | 880 | 234 | 22 | 550 | 56 | 870 | 35 | 809 |
| 43 | | 1250 | 170 | 880 | 228 | 10 | 550 | 56 | 900 | 35 | 741 |
| 44 | | 1250 | 51 | 880 | 229 | 12 | 550 | 56 | 930 | 35 | 680 |
| 45 | J | 1250 | 84 | 880 | 230 | 15 | 550 | 56 | 890 | 28 | 730 |
| 46 | | 1250 | 89 | 880 | 247 | 17 | 550 | 56 | 880 | 32 | 799 |
| 47 | | 1250 | 66 | 880 | 246 | 16 | 550 | 56 | 889 | 35 | 767 |
| 48 | K | 1250 | 95 | 880 | 241 | 14 | 550 | 56 | 879 | 35 | 755 |
| 49 | | 1250 | 69 | 880 | 300 | 13 | 550 | 56 | 886 | 50 | 809 |
| 50 | | 1250 | 86 | 880 | 220 | 12 | 550 | 56 | 870 | 70 | 849 |
| 51 | L | 1250 | 66 | 880 | 150 | 15 | 550 | 56 | 863 | 35 | 650 |
| 52 | | 1250 | 64 | 880 | 170 | 18 | 550 | 56 | 861 | 35 | 700 |
| 53 | | 1250 | 87 | 880 | 247 | 10 | 550 | 56 | 903 | 35 | 755 |

TABLE 2-2-continued

| | | | | | | | | | | | |
|---|---|---|---|---|---|---|---|---|---|---|---|
| 54 | M | 1250 | 56 | 880 | 242 | 11 | 550 | 56 | 891 | 35 | 702 |
| 55 | | 1250 | 53 | 880 | 245 | 4 | 550 | 56 | 875 | 35 | 727 |
| 56 | | 1250 | 62 | 880 | 239 | 15 | 550 | 56 | 878 | 35 | 635 |
| 57 | N | 1250 | 56 | 880 | 234 | 14 | 550 | 56 | 876 | 35 | 757 |
| 58 | | 1250 | 55 | 880 | 235 | 15 | 550 | 56 | 895 | 35 | 824 |
| 59 | | 1250 | 85 | 880 | 237 | 16 | 550 | 56 | 884 | 35 | 754 |

| | Annealing Condition | | | | Electrogalvanizing Condition | | Tempering Condition | | |
|---|---|---|---|---|---|---|---|---|---|
| No. | Average Cooling Rate*4 ° C./s | Cooling Stop Temperature ° C. | Holding Temperature ° C. | Holding Time sec | Kind of Coating Layer | Electrogalvanizing Time sec | Holding Temperature ° C. | Holding Time sec | |
| 33 | 1977 | 25 | 200 | 700 | Zn—Ni | 130 | | | Comparative Example |
| 34 | 1809 | 25 | 200 | 700 | Zn—Ni | 130 | 150 | 20 | Example |
| 35 | 1503 | 25 | 200 | 800 | Zn—Ni | 120 | 150 | 150 | Example |
| 36 | 1592 | 25 | 200 | 700 | Zn—Ni | 110 | | | Example |
| 37 | 1653 | 25 | 200 | 600 | Zn—Ni | 380 | | | Comparative Example |
| 38 | 1513 | 25 | 200 | 600 | Zn—Ni | 180 | | | Example |
| 39 | 1914 | 50 | 200 | 700 | Zn—Ni | 120 | | | Comparative Example |
| 40 | 1873 | 50 | 200 | 800 | Zn—Ni | 120 | | | Example |
| 41 | 1807 | 50 | 200 | 900 | Zn—Ni | 170 | | | Example |
| 42 | 1596 | 50 | 100 | 800 | Zn—Ni | 200 | | | Comparative Example |
| 43 | 1810 | 25 | 200 | 900 | Zn—Ni | 100 | | | Example |
| 44 | 1961 | 25 | 200 | 600 | Zn | 160 | | | Example |
| 45 | 1745 | 100 | 200 | 600 | Zn | 120 | | | Comparative Example |
| 46 | 1688 | 100 | 200 | 900 | Zn | 120 | | | Example |
| 47 | 1913 | 100 | 200 | 900 | Zn | 370 | | | Comparative Example |
| 48 | 1556 | 100 | 200 | 700 | Zn | 120 | | | Example |
| 49 | 1519 | 100 | 200 | 700 | Zn | 100 | | | Example |
| 50 | 1545 | 100 | 200 | 700 | Zn | 190 | | | Example |
| 51 | 1968 | 100 | 200 | 900 | Zn | 100 | | | Comparative Example |
| 52 | 1659 | 100 | 200 | 600 | Zn | 120 | | | Example |
| 53 | 1683 | 100 | 200 | 800 | Zn | 160 | | | Example |
| 54 | 1709 | 50 | 200 | 900 | Zn | 170 | | | Example |
| 55 | 1726 | 50 | 200 | 700 | Zn | 120 | | | Example |
| 56 | 1888 | 50 | 200 | 800 | Zn | 150 | | | Comparative Example |
| 57 | 1500 | 50 | 200 | 700 | Zn | 190 | | | Example |
| 58 | 800 | 25 | 200 | 700 | Zn | 130 | | | Example |
| 59 | 50 | 25 | 200 | 600 | Zn | 170 | | | Comparative Example |

*1Rolling time in a temperature range from a temperature of 1150° C. to the finishing delivery temperature

*2 Average cooling rate from the finishing delivery temperature to a temperature of 700° C.

*3 Average cooling rate in a temperature range of 700° C. (primary cooling stop temperature) to 650° C.

*4Average cooling rate in a temperature range of 680° C. to 260° C.

Underlined portions indicate items out of the range according to aspects of the present invention.

TABLE 2-3

| | | Hot Rolling | | | | | | Cold Rolling | Annealing Condition | | |
|---|---|---|---|---|---|---|---|---|---|---|---|
| No. | Steel Grade | Slab Heating Temperature ° C. | Rolling Time*1 sec | Finishing Delivery Temperature ° C. | Average Cooling Rate to 700° C. *2 ° C./s | Average Cooling Rate to 650° C. *3 ° C./s | Coiling Temperature ° C. | Rolling Reduction Ratio % | Annealing Temperature ° C. | Annealing Holding Time sec | Cooling Start Temperature ° C. |
| 60 | O | 1250 | 80 | 880 | 180 | 11 | 550 | 56 | 881 | 35 | 694 |
| 61 | | 1250 | 80 | 880 | 120 | 10 | 550 | 56 | 877 | 35 | 877 |
| 62 | | 1250 | 62 | 880 | 60 | 17 | 550 | 56 | 876 | 35 | 793 |
| 63 | P | 1250 | 71 | 880 | 50 | 15 | 550 | 56 | 863 | 35 | 753 |
| 64 | | 1250 | 70 | 880 | 237 | 18 | 550 | 56 | 877 | 35 | 848 |
| 65 | | 1250 | 97 | 880 | 235 | 14 | 550 | 56 | 871 | 35 | 766 |
| 66 | Q | 1250 | 94 | 880 | 233 | 15 | 550 | 56 | 872 | 35 | 845 |
| 67 | | 1250 | 65 | 880 | 238 | 11 | 550 | 56 | 871 | 35 | 788 |
| 68 | | 1250 | 97 | 880 | 241 | 12 | 550 | 56 | 892 | 35 | 783 |
| 69 | R | 1250 | 91 | 880 | 240 | 15 | 550 | 56 | 909 | 35 | 882 |
| 70 | | 1250 | 89 | 880 | 241 | 13 | 550 | 56 | 881 | 35 | 875 |
| 71 | | 1250 | 78 | 880 | 240 | 14 | 550 | 56 | 860 | 35 | 684 |
| 72 | S | 1250 | 94 | 880 | 246 | 16 | 550 | 56 | 877 | 35 | 705 |
| 73 | | 1250 | 87 | 880 | 238 | 11 | 550 | 56 | 898 | 35 | 755 |
| 74 | | 1250 | 64 | 880 | 237 | 12 | 550 | 56 | 894 | 35 | 702 |
| 75 | T | 1150 | 74 | 880 | 237 | 14 | 550 | 56 | 898 | 35 | 880 |
| 76 | | 1250 | 83 | 880 | 235 | 17 | 550 | 56 | 869 | 35 | 743 |
| 77 | | 1250 | 75 | 880 | 239 | 18 | 700 | 56 | 899 | 35 | 686 |

TABLE 2-3-continued

| | | | | | | | | | | | |
|---|---|---|---|---|---|---|---|---|---|---|---|
| 78 | U | 1250 | 72 | 830 | 242 | 15 | 550 | 56 | 908 | 35 | 896 |
| 79 | | 1250 | 60 | 880 | 243 | 19 | 550 | 56 | 899 | 35 | 718 |
| 80 | | 1250 | 63 | 880 | 400 | 15 | 550 | 56 | 800 | 35 | 754 |
| 81 | V | 1250 | 73 | 880 | 140 | 14 | 550 | — | 886 | 35 | 700 |
| 82 | | 1250 | 60 | 880 | 45 | 12 | 550 | — | 897 | 35 | 694 |
| 83 | | 1250 | 69 | 880 | 160 | 15 | 550 | — | 894 | 35 | 803 |
| 84 | W | 1250 | 69 | 880 | 1148 | 16 | 550 | 56 | 890 | 35 | 838 |
| 85 | | 1250 | 88 | 880 | 500 | 12 | 550 | 56 | 889 | 35 | 753 |
| 86 | | 1250 | 92 | 880 | 170 | 11 | 550 | 56 | 893 | 35 | 826 |
| 87 | X | 1250 | 73 | 880 | 45 | 10 | 550 | 56 | 876 | 35 | 700 |
| 88 | | 1250 | 51 | 880 | 110 | 15 | 550 | 56 | 898 | 35 | 857 |
| 89 | | 1250 | 60 | 880 | 70 | 17 | 550 | 56 | 908 | 35 | 740 |

| | Annealing Condition | | | | Electrogalvanizing Condition | | Tempering Condition | | |
|---|---|---|---|---|---|---|---|---|---|
| No. | Average Cooling Rate*4 ° C./s | Cooling Stop Temperature ° C. | Holding Temperature ° C. | Holding Time sec | Kind of Coating Layer | Electrogalvanizing Time sec | Holding Temperature ° C. | Holding Time sec | |
| 60 | 80 | 25 | 200 | 700 | Zn | 160 | | | Example |
| 61 | 800 | 25 | 200 | 600 | Zn | 140 | | | Example |
| 62 | 1500 | 25 | 200 | 700 | Zn | 190 | | | Example |
| 63 | 1786 | 25 | 200 | 10 | Zn | 140 | | | Comparative Example |
| 64 | 1756 | 25 | 200 | 80 | Zn | 160 | | | Example |
| 65 | 1956 | 25 | 200 | 300 | Zn | 150 | | | Example |
| 66 | 1824 | 25 | 200 | 700 | Zn | 200 | | | Example |
| 67 | 1787 | 25 | 200 | 1300 | Zn | 140 | | | Example |
| 68 | 1676 | 25 | 200 | 1600 | Zn | 180 | | | Comparative Example |
| 69 | 1990 | 25 | 200 | 800 | Zn | 150 | | | Example |
| 70 | 1732 | 25 | 200 | 700 | Zn | 240 | | | Example |
| 71 | 1809 | 25 | 200 | 600 | Zn | 350 | | | Comparative Example |
| 72 | 1634 | 25 | 200 | 900 | Zn | 180 | | | Example |
| 73 | 1737 | 25 | 300 | 900 | Zn | 140 | | | Comparative Example |
| 74 | 1851 | 25 | 200 | 900 | Zn | 360 | | | Comparative Example |
| 75 | 1804 | 25 | 200 | 600 | Zn—Fe | 200 | | | Comparative Example |
| 76 | 1666 | 25 | 200 | 700 | Zn—Fe | 130 | | | Example |
| 77 | 1965 | 25 | 200 | 700 | Zn—Fe | 140 | | | Comparative Example |
| 78 | 1999 | 25 | 200 | 700 | Zn—Fe | 160 | | | Comparative Example |
| 79 | 1823 | 25 | 200 | 900 | Zn—Fe | 100 | | | Example |
| 80 | 1574 | 25 | 200 | 700 | Zn—Fe | 110 | | | Comparative Example |
| 81 | 1621 | 25 | 200 | 600 | Zn—Fe | 100 | | | Example |
| 82 | 1864 | 25 | 200 | 800 | Zn—Fe | 130 | | | Example |
| 83 | 1781 | 25 | 200 | 800 | Zn—Fe | 140 | | | Example |
| 84 | 1909 | 25 | 150 | 700 | Zn—Fe | 160 | | | Example |
| 85 | 1651 | 25 | 170 | 10 | Zn—Fe | 100 | | | Comparative Example |
| 86 | 1969 | 25 | 190 | 900 | Zn—Fe | 180 | | | Example |
| 87 | 1526 | 25 | 210 | 1600 | Zn—Fe | 130 | | | Comparative Example |
| 88 | 1594 | 25 | 230 | 900 | Zn—Fe | 160 | | | Example |
| 89 | 1915 | 25 | 250 | 700 | Zn—Fe | 110 | | | Example |

*1Rolling time in a temperature range from a temperature of 1150° C. to the finishing delivery temperature

*2 Average cooling rate from the finishing delivery temperature to a temperature of 700° C.

*3 Average cooling rate in a temperature range of 700° C. (primary cooling stop temperature) to 650° C.

*4Average cooling rate in a temperature range of 680° C. to 260° C.

Underlined portions indicate items out of the range according to aspects of the present invention.

TABLE 2-4

| | | Hot Rolling | | | | | | Cold Rolling | Annealing Condition | | |
|---|---|---|---|---|---|---|---|---|---|---|---|
| No. | Steel Grade | Slab Heating Temperature ° C. | Rolling Time*1 sec | Finishing Delivery Temperature ° C. | Average Cooling Rate to 700° C. *2 ° C./s | Average Cooling Rate to 650° C. *3 ° C./s | Coiling Temperature ° C. | Rolling Reduction Ratio % | Annealing Temperature ° C. | Annealing Holding Time sec | Cooling Start Temperature ° C. |
| 90 | Y | 1250 | 220 | 880 | 50 | 18 | 550 | 56 | 908 | 35 | 740 |
| 91 | | 1250 | 90 | 880 | 1187 | 16 | 550 | 56 | 908 | 35 | 740 |
| 92 | | 1250 | 105 | 880 | 130 | 15 | 550 | 56 | 908 | 35 | 740 |
| 93 | | 1250 | 68 | 880 | 60 | 18 | 550 | 56 | 886 | 35 | 881 |
| 94 | | 1250 | 75 | 880 | 15 | 15 | 550 | 56 | 889 | 35 | 705 |
| 95 | | 1250 | 50 | 880 | 120 | 15 | 550 | 56 | 883 | 35 | 853 |
| 96 | Z | 1250 | 80 | 880 | 237 | 60 | 550 | 56 | 894 | 35 | 715 |
| 97 | | 1250 | 77 | 880 | 234 | 4 | 550 | 56 | 904 | 28 | 697 |
| 98 | | 1250 | 81 | 880 | 241 | 28 | 550 | 56 | 905 | 85 | 804 |

TABLE 2-4-continued

| | | | | | | | | | | | |
|---|---|---|---|---|---|---|---|---|---|---|---|
| 99 | AA | 1250 | 91 | 880 | 246 | 31 | 550 | 56 | 898 | 35 | 831 |
| 100 | | 1250 | 66 | 880 | 242 | 8 | 550 | 56 | 902 | 35 | 801 |
| 101 | | 1250 | 57 | 880 | 236 | 14 | 550 | 56 | 906 | 35 | 726 |
| 102 | AB | 1250 | 99 | 880 | 235 | 8 | 550 | 56 | 910 | 35 | 807 |
| 103 | | 1250 | 100 | 880 | 233 | 4 | 550 | 56 | 883 | 35 | 688 |
| 104 | | 1250 | 51 | 880 | 232 | 1 | 550 | 56 | 875 | 35 | 764 |
| 105 | AC | 1250 | 99 | 880 | 229 | 15 | 550 | 56 | 873 | 35 | 829 |
| 106 | AD | 1250 | 50 | 880 | 230 | 16 | 550 | 56 | 904 | 35 | 680 |
| 107 | AE | 1250 | 60 | 880 | 227 | 14 | 550 | 56 | 912 | 35 | 792 |
| 108 | AF | 1250 | 62 | 880 | 230 | 12 | 550 | 56 | 894 | 35 | 755 |
| 109 | AG | 1250 | 59 | 880 | 229 | 11 | 550 | 56 | 890 | 35 | 719 |
| 110 | AH | 1250 | 66 | 880 | 225 | 10 | 550 | 56 | 870 | 35 | 794 |
| 111 | AI | 1250 | 54 | 880 | 234 | 15 | 550 | 56 | 869 | 35 | 733 |
| 112 | AJ | 1250 | 95 | 880 | 236 | 18 | 550 | 56 | 900 | 35 | 682 |
| 113 | AK | 1250 | 67 | 880 | 228 | 17 | 550 | 56 | 886 | 35 | 870 |
| 114 | AL | 1250 | 64 | 880 | 229 | 15 | 550 | 56 | 877 | 35 | 697 |
| 115 | AM | 1250 | 57 | 880 | 230 | 16 | 550 | 56 | 904 | 35 | 782 |
| 116 | AN | 1250 | 53 | 880 | 230 | 15 | 550 | 56 | 891 | 35 | 820 |

| | Annealing Condition | | | | Electrogalvanizing Condition | | Tempering Condition | | |
|---|---|---|---|---|---|---|---|---|---|
| No. | Average Cooling Rate*4 ° C./s | Cooling Stop Temperature ° C. | Holding Temperature ° C. | Holding Time sec | Kind of Coating Layer | Electrogalvanizing Time sec | Holding Temperature ° C. | Holding Time sec | |
| 90 | 1915 | 25 | 250 | 700 | Zn—Fe | 110 | | | Example |
| 91 | 1915 | 25 | 250 | 700 | Zn—Fe | 110 | | | Example |
| 92 | 1915 | 25 | 250 | 700 | Zn—Fe | 110 | | | Example |
| 93 | 100 | 25 | 200 | 600 | Zn—Fe | 110 | | | Example |
| 94 | 300 | 25 | 200 | 600 | Zn—Fe | 100 | | | Comparative Example |
| 95 | 700 | 25 | 200 | 600 | Zn—Fe | 140 | | | Example |
| 96 | 1000 | 50 | 200 | 900 | Zn—Fe | 150 | | | Example |
| 97 | 1890 | 50 | 200 | 700 | Zn—Fe | 180 | | | Comparative Example |
| 98 | 1586 | 50 | 200 | 600 | Zn—Fe | 190 | | | Example |
| 99 | 1706 | 50 | 270 | 800 | Zn—Fe | 110 | | | Comparative Example |
| 100 | 1600 | 50 | 250 | 800 | Zn—Fe | 170 | | | Example |
| 101 | 1831 | 50 | 230 | 800 | Zn—Fe | 190 | | | Example |
| 102 | 60 | 50 | 200 | 800 | Zn—Fe | 190 | | | Comparative Example |
| 103 | 450 | 50 | 200 | 800 | Zn—Fe | 120 | | | Example |
| 104 | 1730 | 50 | 200 | 600 | Zn—Fe | 120 | | | Comparative Example |
| 105 | 1526 | 50 | 200 | 600 | Zn—Ni | 110 | | | Comparative Example |
| 106 | 1799 | 50 | 200 | 600 | Zn—Ni | 150 | | | Comparative Example |
| 107 | 1987 | 50 | 200 | 800 | Zn—Ni | 200 | | | Comparative Example |
| 108 | 1692 | 50 | 200 | 900 | Zn—Ni | 130 | | | Comparative Example |
| 109 | 1654 | 50 | 200 | 600 | Zn—Ni | 120 | | | Comparative Example |
| 110 | 1743 | 50 | 200 | 800 | Zn—Ni | 140 | | | Comparative Example |
| 111 | 1671 | 50 | 200 | 700 | Zn—Ni | 130 | | | Comparative Example |
| 112 | 1564 | 50 | 200 | 900 | Zn—Ni | 130 | | | Comparative Example |
| 113 | 1898 | 50 | 200 | 700 | Zn—Ni | 160 | | | Comparative Example |
| 114 | 1922 | 50 | 200 | 600 | Zn—Ni | 160 | | | Comparative Example |
| 115 | 1539 | 50 | 200 | 800 | Zn—Ni | 190 | | | Comparative Example |
| 116 | 1843 | 50 | 200 | 700 | Zn—Ni | 130 | | | Comparative Example |

*1 Rolling time in a temperature range from a temperature of 1150° C. to the finishing delivery temperature

*2 Average cooling rate from the finishing delivery temperature to a temperature of 700° C.

*3 Average cooling rate in a temperature range of 700° C. (primary cooling stop temperature) to 650° C.

*4 Average cooling rate in a temperature range of 680° C. to 260° C.

Underlined portions indicate items out of the range according to aspects of the present invention.

2. Evaluation Method

The phase fractions, tensile properties such as tensile strength, and bendability of the electrogalvanized steel sheets obtained under various manufacturing conditions were observed by performing respectively steel microstructure analysis, a tensile test, and a bending test. Each of the evaluation methods is as follows.

(Total Area Fraction of One or Both of Bainite Containing Carbides Having an Average Grain Diameter of 50 Nm or Less and Tempered Martensite Containing Carbides Having an Average Grain Diameter of 50 nm or Less)

After a test piece in the rolling direction or in a direction perpendicular to the rolling direction had been taken from each of the electrogalvanized steel sheet, mirror polishing was performed on the L-cross-section in the thickness direction parallel to the rolling direction of the test piece, etching was performed on the polished L-cross-section in a Nital solution to reveal the microstructure, observation with a scanning electron microscope was performed on the etched L-cross-section, and the area fractions of tempered martensite (denoted by TM in Table 3-1 through Table 3-4) and bainite (denoted by B in Table 3-1 through Table 3-4) were investigated by using a point-counting method in such a manner that a grid having a number of grid points of 16×15 at intervals of 4.8 μm was placed on a region having an actual size of 82 μm×57 μm in a SEM image at a magnification of 1500 times and the number of grid points found on each of the phases was counted. The total area fraction of one or both of bainite containing carbides having an average grain diameter of 50 nm or less and tempered martensite containing carbides having an average grain diameter of 50 nm or less in the whole microstructure was defined as the average value of the area fractions in the SEM images obtained by continuously performing observation with a SEM at a magnification of 1500 times across the whole thickness. The total area fraction of one or both of bainite containing carbides having an average grain diameter of 50 nm or less and tempered martensite containing carbides having an average grain diameter of 50 nm or less in a region from the surface of the base steel sheet to a position located at ⅛ of the thickness of the base steel sheet was defined as the average value of the area fractions in the SEM images obtained by continuously performing observation with a SEM at a magnification of 1500 times across the whole region from the surface of the base steel sheet to a position located at ⅛ of the thickness of the base steel sheet. Tempered martensite and bainite are identified as white microstructures in which blocks and packets are observed inside prior austenite grains and in which carbides having a small grain diameter are precipitated. In addition, since there may be a case where the carbides are difficult to observe depending on the plane orientation of a block grain or etching quality, it is necessary to sufficiently perform etching for confirmation in such a case. Here, the average grain diameter of carbides contained in tempered martensite and bainite was calculated by using the following method.

(Average Grain Diameter of Carbides Inside Tempered Martensite and Bainite)

After a test piece in the rolling direction or in a direction perpendicular to the rolling direction had been taken from each of the electrogalvanized steel sheet, mirror polishing was performed on the L-cross-section in the thickness direction parallel to the rolling direction of the test piece, etching was performed on the polished L-cross-section in a Nital solution to reveal the microstructure, observation with a scanning electron microscope was continuously performed across the whole region from the surface of the base steel sheet to a position located at ⅛ of the thickness of the base steel sheet, the number of carbides inside prior austenite grains containing tempered martensite and bainite was calculated from one of the SEM images at a magnification of 5000 times, and the total area of carbides inside one crystal grain was calculated by binarizing the microstructure. From the number of carbides and the total area of carbides, the area per one carbide grain was calculated, and the average grain diameter of carbides in the region from the surface of the base steel sheet to a position located at ⅛ of the thickness of the base steel sheet was calculated. The average grain diameter of carbides in the whole microstructure was determined by using the same calculating method as that for calculating the average grain diameter of carbides in the region from the surface of the base steel sheet to a position located at ⅛ of the thickness of the base steel sheet after having observed a position located at ¼ of the thickness of the base steel sheet with a scanning electron microscope. Here, the microstructure at a position located at ¼ of the thickness of the steel sheet is regarded as representing the average microstructure of the whole microstructure.

(Sum of Perimeters of Carbides Having an Average Grain Diameter of 0.1 μm or More and Inclusions)

After a test piece in the rolling direction or in a direction perpendicular to the rolling direction had been taken from each of the electrogalvanized steel sheet, mirror polishing was performed on the L-cross-section in the thickness direction parallel to the rolling direction of the test piece, observation with an optical microscope was performed on the polished L-section without performing etching to reveal the microstructure, and inclusions were identified as black regions in an optical microscope photograph at a magnification of 400 times. In addition, after a test piece in the rolling direction or in a direction perpendicular to the rolling direction was taken from each of the electrogalvanized steel sheet, mirror polishing was performed on the L-cross-section in the thickness direction parallel to the rolling direction of the test piece, etching was performed on the polished L-cross-section in a Nital solution to reveal the microstructure, observation with a scanning electron microscope was performed on the etched L-cross-section, and carbides having a large average grain diameter of 0.1 μm or more were observed in a SEM image at a magnification of 5000 times. The long side length and short side length of the inclusions or the carbides were determined, and the average value of the side lengths was defined as the average grain diameter. In addition, the perimeter of each of the carbides having an average grain diameter of 0.1 μm or more and the inclusions was calculated by multiplying the average grain diameter by the circular constant π, and the sum of the calculated perimeters was defined as the sum of the perimeters of the carbides having an average grain diameter of 0.1 μm or more and the inclusions.

(Tensile Test)

After a JIS No. 5 test piece in the rolling direction having a gage length of 50 mm, a gage width of 25 mm, and a thickness of 1.4 mm had been taken from each of the electrogalvanized steel sheet, a tensile test was performed with a cross head speed of 10 mm/min to determine the tensile strength (denoted by TS in Table 3-1 through Table 3-4), the yield strength (denoted by YS in Table 3-1 through Table 3-4), and the elongation (denoted by El in Table 3-1 through Table 3-4). In addition, the yield ratio (denoted by YR in Table 3-1 through Table 3-4) was calculated as YS/TS.

(Bending Test)

After a strip-shaped test piece having a long side length of 100 mm and a short side length of 30 mm in a direction perpendicular to the rolling direction had been taken for each of the electrogalvanized steel sheet by performing shearing on the long side having a length of 100 mm with the sheared end surface being left as sheared (without performing machining to remove burrs), bending work was performed so that the burrs were on the outer side of bending. Bending work was performed so that the bending angle on the inner side of the peak-like bending position was 90 degrees (V-bend). The end bending radius was defined as R, the thickness of the steel sheet was defined as t, and evaluation was performed on the basis of R/t.

(Hydrogen Analysis Method)

A strip-shaped test piece having a long side length of 30 mm and a short side length of 5 mm was taken from the central portion in the width direction of each of the electrogalvanized steel sheet. After the coating layer formed on the surface of the strip-shaped test piece had been completely removed by using a handy router, hydrogen analysis was performed by using a thermal desorption analytical device at a heating rate of 200° C./hr. The hydrogen analysis was performed immediately after the strip-shaped test piece had been taken and the coating layer had been removed. The amount of accumulated hydrogen which was released in a temperature range from the heating start temperature (25° C.) to a temperature of 200° C. was determined, and the determined value was defined as the amount of diffusible hydrogen in steel.

3. Evaluation Result

The evaluation results obtained as described above are given in Table 3-1 through Table 3-4.

TABLE 3-1

| | | Microstructure | | | | Mechanical Property | | | | | |
|---|---|---|---|---|---|---|---|---|---|---|---|
| No. | Steel Grade | TM + B*1 % | TM + B in Surface Layer *2 % | Total Perimeter of Inclusion and Carbide Having Large Grain Diameter*3 μm/mm² | Diffusible Hydrogen in Steel mass ppm | YS MPa | TS MPa | EI % | YR | R/t | |
| 1 | A | 94 | 87 | 3.5 | 0.12 | 1512 | 1810 | 6.9 | 0.84 | 4.1 | Example |
| 2 | | 95 | 88 | 65 | 0.04 | 1452 | 1720 | 7.4 | 0.84 | 3.8 | Example |
| 3 | | 95 | 88 | 5 | 0.02 | 1537 | 1820 | 6.6 | 0.84 | 3.5 | Example |
| 4 | | 86 | 90 | 30 | 0.21 | 1376 | 1800 | 7.2 | 0.76 | 4.6 | Comparative Example |
| 5 | | 92 | 87 | 0 | 0.06 | 1480 | 1810 | 6.8 | 0.82 | 3.5 | Example |
| 6 | | 98 | 92 | 15 | 0.03 | 1551 | 1780 | 6.8 | 0.87 | 3.6 | Example |
| 7 | | 95 | 80 | 35 | 0.17 | 1512 | 1790 | 6.9 | 0.84 | 4.2 | Example |
| 8 | | 100 | 82 | 20 | 0.29 | 1609 | 1810 | 6.7 | 0.89 | 4.8 | Comparative Example |
| 9 | B | 85 | 88 | 60 | 0.03 | 1324 | 1520 | 8.4 | 0.87 | 3.8 | Comparative Example |
| 10 | | 99 | 83 | 40 | 0.14 | 1364 | 1550 | 8.1 | 0.88 | 3.6 | Example |
| 11 | | 96 | 84 | 5 | 0.05 | 1306 | 1530 | 8.5 | 0.85 | 3.2 | Example |
| 12 | | 93 | 89 | 5 | 0.04 | 1232 | 1490 | 8.1 | 0.83 | 2.7 | Example |
| 13 | C | 84 | 87 | 65 | 0.15 | 1320 | 1580 | 7.7 | 0.84 | 4.1 | Comparative Example |
| 14 | | 96 | 85 | 30 | 0.11 | 1357 | 1590 | 8.1 | 0.85 | 3.5 | Example |
| 15 | | 100 | 87 | 15 | 0.03 | 1431 | 1610 | 8.1 | 0.89 | 3.6 | Example |
| 16 | | 90 | 83 | 10 | 0.09 | 1248 | 1560 | 8.1 | 0.80 | 3.6 | Example |
| 17 | | 98 | 91 | 10 | 0.04 | 1368 | 1570 | 8.2 | 0.87 | 3.5 | Example |
| 18 | D | 93 | 93 | 70 | 0.01 | 1637 | 1980 | 6.2 | 0.83 | 4.3 | Example |
| 19 | | 92 | 81 | 35 | 0.05 | 1733 | 2010 | 6.5 | 0.86 | 4.3 | Example |
| 20 | | 99 | 77 | 15 | 0.08 | 1760 | 2000 | 6.3 | 0.88 | 4.8 | Comparative Example |
| 21 | | 93 | 71 | 20 | 0.07 | 1629 | 1970 | 6.6 | 0.83 | 4.8 | Comparative Example |
| 22 | E | 87 | 83 | 15 | 0.30 | 1369 | 1770 | 7.1 | 0.77 | 4.7 | Comparative Example |
| 23 | | 91 | 81 | 30 | 0.16 | 1448 | 1790 | 6.7 | 0.81 | 4.3 | Example |
| 24 | | 100 | 82 | 40 | 0.11 | 1618 | 1820 | 6.8 | 0.89 | 4.1 | Example |
| 26 | | 90 | 88 | 30 | 0.02 | 1424 | 1780 | 7.1 | 0.80 | 3.6 | Example |
| 27 | | 100 | 89 | 75 | 0.13 | 1609 | 1810 | 7.0 | 0.89 | 4.1 | Example |
| 28 | | 94 | 90 | 30 | 0.14 | 1496 | 1790 | 7.2 | 0.84 | 4.0 | Example |
| 29 | | 98 | 86 | 15 | 0.26 | 1568 | 1800 | 7.2 | 0.87 | 4.6 | Comparative Example |
| 30 | | 91 | 87 | 30 | 0.12 | 1432 | 1770 | 6.9 | 0.81 | 3.9 | Example |
| 31 | | 95 | 84 | 20 | 0.18 | 1503 | 1780 | 7.2 | 0.84 | 4.2 | Example |
| 32 | | 98 | 84 | 5 | 0.26 | 1559 | 1790 | 7.0 | 0.87 | 4.7 | Comparative Example |

*1 The total area fraction of one or both of B containing carbides having an average grain diameter of 50 nm or less and TM containing carbides having an average grain diameter of 50 nm or less in the whole microstructure

*2 The total area fraction of one or both of B containing carbides having an average grain diameter of 50 nm or less and TM containing carbides having an average grain diameter of 50 nm or less in a region (surface layer) from the surface of the base steel sheet to a position located at 1/8 of the thickness of the base steel sheet

*3 The sum of perimeters of carbides having an average grain diameter of 0.1 μm or more and inclusions Underlined portions indicate items out of the range according to aspects of the present invention.

TABLE 3-2

| | | Microstructure | | | | Mechanical Property | | | | | |
|---|---|---|---|---|---|---|---|---|---|---|---|
| No. | Steel Grade | TM + B*1 % | TM+B in Surface Layer *2 % | Total Perimeter of Inclusion and Carbide Having Large Grain Diameter*3 μm/mm² | Diffusible Hydrogen in Steel mass ppm | YS MPa | TS MPa | EI % | YR | R/t | |
| 33 | F | 88 | 84 | 10 | 0.02 | 1291 | 1650 | 7.7 | 0.78 | 4.3 | Comparative Example |
| 34 | | 90 | 84 | 5 | 0.03 | 1344 | 1680 | 7.5 | 0.80 | 3.5 | Example |
| 35 | | 93 | 83 | 40 | 0.01 | 1430 | 1730 | 7.2 | 0.83 | 3.8 | Example |
| 36 | G | 92 | 84 | 10 | 0.08 | 1423 | 1740 | 7.2 | 0.82 | 3.7 | Example |
| 37 | | 96 | 86 | 20 | 0.28 | 1493 | 1750 | 7.0 | 0.85 | 4.6 | Comparative Example |
| 38 | | 99 | 81 | 10 | 0.14 | 1549 | 1760 | 7.2 | 0.88 | 4.2 | Example |
| 39 | H | 86 | 84 | 15 | 0.04 | 1170 | 1530 | 7.9 | 0.76 | 3.2 | Comparative Example |
| 40 | | 91 | 85 | 25 | 0.08 | 1246 | 1540 | 8.4 | 0.81 | 3.3 | Example |
| 41 | | 94 | 85 | 40 | 0.10 | 1287 | 1540 | 7.9 | 0.84 | 3.5 | Example |
| 42 | I | 98 | 96 | 40 | 0.25 | 1359 | 1560 | 8.3 | 0.87 | 4.1 | Comparative Example |
| 43 | | 93 | 86 | 15 | 0.06 | 1273 | 1540 | 8.1 | 0.83 | 3.6 | Example |
| 44 | | 95 | 86 | 40 | 0.03 | 1309 | 1550 | 7.7 | 0.84 | 3.5 | Example |
| 45 | J | 80 | 78 | 60 | 0.16 | 1671 | 1880 | 6.4 | 0.89 | 4.7 | Comparative Example |
| 46 | | 91 | 82 | 5 | 0.10 | 1464 | 1810 | 6.9 | 0.81 | 3.8 | Example |
| 47 | | 94 | 83 | 40 | 0.27 | 1521 | 1820 | 6.6 | 0.84 | 4.8 | Comparative Example |
| 48 | K | 91 | 83 | 30 | 0.17 | 1488 | 1840 | 7.1 | 0.81 | 4.3 | Example |

TABLE 3-2-continued

| | | Microstructure | | | | Mechanical Property | | | | | |
|---|---|---|---|---|---|---|---|---|---|---|---|
| No. | Steel Grade | TM + B*1 % | TM+B in Surface Layer *2 % | Total Perimeter of Inclusion and Carbide Having Large Grain Diameter*3 μm/mm² | Diffusible Hydrogen in Steel mass ppm | YS MPa | TS MPa | EI % | YR | R/t | |
| 49 | | 100 | 84 | 30 | 0.13 | 1671 | 1880 | 6.6 | 0.89 | 4.2 | Example |
| 50 | | 98 | 82 | 5 | 0.12 | 1629 | 1870 | 7.0 | 0.87 | 4.1 | Example |
| 51 | L | 83 | 81 | 30 | 0.18 | 1158 | 1570 | 8.1 | 0.74 | 3.7 | Comparative Example |
| 52 | | 92 | 88 | 10 | 0.16 | 1325 | 1620 | 7.5 | 0.82 | 3.5 | Example |
| 53 | | 97 | 93 | 10 | 0.12 | 1440 | 1670 | 7.5 | 0.86 | 3.4 | Example |
| 54 | M | 91 | 89 | 30 | 0.14 | 1278 | 1580 | 8.2 | 0.81 | 3.7 | Example |
| 55 | | 95 | 82 | 15 | 0.02 | 1351 | 1600 | 8.1 | 0.84 | 3.4 | Example |
| 56 | | 82 | 80 | 10 | 0.15 | 1086 | 1490 | 8.7 | 0.73 | 3.1 | Comparative Example |
| 57 | N | 93 | 91 | 25 | 0.14 | 1356 | 1640 | 7.4 | 0.83 | 3.6 | Example |
| 58 | | 90 | 88 | 35 | 0.13 | 1296 | 1620 | 7.7 | 0.80 | 3.6 | Example |
| 59 | | 80 | 76 | 40 | 0.13 | 1074 | 1510 | 8.2 | 0.71 | 3.3 | Comparative Example |

*1The total area fraction of one or both of B containing carbides having an average grain diameter of 50 nm or less and TM containing carbides having an average grain diameter of 50 nm or less in the whole microstructure

*2 The total area fraction of one or both of B containing carbides having an average grain diameter of 50 nm or less and TM containing carbides having an average grain diameter of 50 nm or less in a region (surface layer) from the surface of the base steel sheet to a position located at ⅛ of the thickness of the base steel sheet

*3The sum of perimeters of carbides having an average grain diameter of 0.1 μm or more and inclusions Underlined portions indicate items out of the range according to aspects of the present invention.

TABLE 3-3

| | | Microstructure | | | | Mechanical Property | | | | | |
|---|---|---|---|---|---|---|---|---|---|---|---|
| No. | Steel Grade | TM + B*1 % | TM + B in Surface Layer *2 % | Total Perimeter of Inclusion and Carbide Having Large Grain Diameter*3 μm/mm² | Diffusible Hydrogen in Steel mass ppm | YS MPa | TS MPa | EI % | YR | R/t | |
| 60 | O | 90 | 85 | 40 | 0.12 | 1288 | 1610 | 7.8 | 0.80 | 3.7 | Example |
| 61 | | 94 | 91 | 20 | 0.01 | 1379 | 1650 | 7.3 | 0.84 | 3.7 | Example |
| 62 | | 98 | 82 | 5 | 0.08 | 1455 | 1670 | 7.2 | 0.87 | 3.8 | Example |
| 63 | P | 95 | 81 | 5 | 0.24 | 1537 | 1820 | 6.9 | 0.84 | 4.7 | Comparative Example |
| 64 | | 93 | 82 | 0 | 0.18 | 1496 | 1810 | 7.0 | 0.83 | 4.4 | Example |
| 65 | | 96 | 89 | 30 | 0.14 | 1570 | 1840 | 6.6 | 0.85 | 4.2 | Example |
| 66 | Q | 91 | 82 | 10 | 0.02 | 1335 | 1650 | 7.4 | 0.81 | 3.3 | Example |
| 67 | | 90 | 87 | 15 | 0.12 | 1312 | 1640 | 7.7 | 0.80 | 3.6 | Example |
| 68 | | 86 | 85 | 70 | 0.02 | 1449 | 1680 | 7.6 | 0.86 | 4.2 | Comparative Example |
| 69 | R | 96 | 88 | 5 | 0.01 | 1408 | 1650 | 7.4 | 0.85 | 3.1 | Example |
| 70 | | 97 | 91 | 10 | 0.09 | 1431 | 1660 | 7.5 | 0.86 | 3.5 | Example |
| 71 | | 94 | 88 | 25 | 0.22 | 1370 | 1640 | 7.6 | 0.84 | 4.2 | Comparative Example |
| 72 | S | 94 | 86 | 40 | 0.11 | 1420 | 1700 | 7.2 | 0.84 | 3.9 | Example |
| 73 | | 86 | 85 | 65 | 0.17 | 1327 | 1640 | 7.7 | 0.81 | 4.2 | Comparative Example |
| 74 | | 90 | 86 | 35 | 0.27 | 1304 | 1630 | 8.0 | 0.80 | 4.3 | Comparative Example |
| 75 | T | 88 | 84 | 70 | 0.14 | 1613 | 1930 | 6.6 | 0.84 | 4.6 | Comparative Example |
| 76 | | 100 | 96 | 25 | 0.09 | 1742 | 1960 | 6.3 | 0.89 | 4.0 | Example |
| 77 | | 87 | 85 | 25 | 0.11 | 1415 | 1830 | 6.6 | 0.77 | 4.5 | Comparative Example |
| 78 | U | 88 | 79 | 65 | 0.12 | 1591 | 1790 | 7.1 | 0.89 | 4.7 | Comparative Example |
| 79 | | 92 | 86 | 10 | 0.07 | 1415 | 1730 | 7.3 | 0.82 | 3.7 | Example |
| 80 | | 82 | 81 | 25 | 0.04 | 1203 | 1650 | 7.4 | 0.73 | 3.6 | Comparative Example |
| 81 | V | 95 | 90 | 35 | 0.13 | 1461 | 1730 | 7.2 | 0.84 | 3.9 | Example |
| 82 | | 96 | 82 | 25 | 0.13 | 1485 | 1740 | 7.1 | 0.85 | 3.9 | Example |
| 83 | | 97 | 87 | 35 | 0.16 | 1509 | 1750 | 7.4 | 0.86 | 4.1 | Example |
| 84 | W | 97 | 91 | 30 | 0.14 | 1474 | 1710 | 7.1 | 0.86 | 4.0 | Example |
| 85 | | 96 | 91 | 40 | 0.25 | 1451 | 1700 | 7.1 | 0.85 | 4.7 | Comparative Example |
| 86 | | 94 | 89 | 35 | 0.15 | 1404 | 1680 | 7.4 | 0.84 | 3.7 | Example |
| 87 | X | 87 | 82 | 60 | 0.14 | 1382 | 1620 | 7.7 | 0.85 | 4.3 | Comparative Example |
| 88 | | 94 | 89 | 5 | 0.07 | 1362 | 1630 | 8.0 | 0.84 | 3.3 | Example |
| 89 | | 94 | 82 | 35 | 0.13 | 1362 | 1630 | 7.6 | 0.84 | 3.7 | Example |

*1The total area fraction of one or both of B containing carbides having an average grain diameter of 50 nm or less and TM containing carbides having an average grain diameter of 50 nm or less in the whole microstructure

*2 The total area fraction of one or both of B containing carbides having an average grain diameter of 50 nm or less and TM containing carbides having an average grain diameter of 50 nm or less in a region (surface layer) from the surface of the base steel sheet to a position located at ⅛ of the thickness of the base steel sheet

*3The sum of perimeters of carbides having an average grain diameter of 0.1 μm or more and inclusions Underlined portions indicate items out of the range according to aspects of the present invention.

TABLE 3-4

| | | Microstructure | | | | Mechanical Property | | | | | |
|---|---|---|---|---|---|---|---|---|---|---|---|
| No. | Steel Grade | TM + B*1 % | TM + B in Surface Layer *2 % | Total Perimeter of Inclusion and Carbide Having Large Grain Diameter*3 μm/mm² | Diffusible Hydrogen in Steel mass ppm | YS MPa | TS MPa | EI % | YR | R/t | |
| 90 | Y | 99 | 85 | 70 | 0.03 | 1478 | 1680 | 7.3 | 0.88 | 3.4 | Example |
| 91 | | 95 | 90 | 15 | 0.03 | 1402 | 1660 | 7.6 | 0.84 | 3.3 | Example |
| 92 | | 98 | 91 | 55 | 0.06 | 1455 | 1670 | 7.7 | 0.87 | 3.5 | Example |
| 93 | | 91 | 82 | 10 | 0.06 | 1310 | 1620 | 7.8 | 0.81 | 3.2 | Example |
| 94 | | 94 | 78 | 25 | 0.08 | 1362 | 1630 | 7.6 | 0.84 | 4.4 | Comparative Example |
| 95 | | 96 | 93 | 35 | 0.07 | 1425 | 1670 | 7.3 | 0.85 | 3.6 | Example |
| 96 | Z | 93 | 82 | 65 | 0.12 | 1454 | 1620 | 7.8 | 0.90 | 3.7 | Example |
| 97 | | 89 | 81 | 55 | 0.12 | 1443 | 1640 | 7.7 | 0.88 | 4.1 | Comparative Example |
| 98 | | 94 | 88 | 25 | 0.16 | 1362 | 1630 | 7.4 | 0.84 | 3.7 | Example |
| 99 | AA | 88 | 91 | 55 | 0.06 | 1298 | 1570 | 7.9 | 0.83 | 4.2 | Comparative Example |
| 100 | | 94 | 92 | 30 | 0.09 | 1312 | 1570 | 8.0 | 0.84 | 3.4 | Example |
| 101 | | 92 | 82 | 20 | 0.14 | 1276 | 1560 | 7.9 | 0.82 | 3.5 | Example |
| 102 | AB | 88 | 89 | 40 | 0.18 | 1134 | 1450 | 8.8 | 0.78 | 3.2 | Comparative Example |
| 103 | | 94 | 83 | 25 | 0.08 | 1287 | 1540 | 8.0 | 0.84 | 3.5 | Example |
| 104 | | 90 | 78 | 20 | 0.17 | 1224 | 1530 | 8.0 | 0.80 | 4.2 | Comparative Example |
| 105 | AC | 88 | 84 | 70 | 0.19 | 1813 | 2060 | 6.3 | 0.88 | 4.7 | Comparative Example |
| 106 | AD | 82 | 71 | 10 | 0.06 | 1013 | 1310 | 9.8 | 0.77 | 2.6 | Comparative Example |
| 107 | AE | 98 | 86 | 80 | 0.03 | 1376 | 1580 | 8.2 | 0.87 | 4.4 | Comparative Example |
| 108 | AF | 93 | 86 | 85 | 0.06 | 1521 | 1840 | 6.7 | 0.83 | 4.9 | Comparative Example |
| 109 | AG | 83 | 88 | 30 | 0.03 | 1055 | 1430 | 8.6 | 0.74 | 3.2 | Comparative Example |
| 110 | AH | 92 | 89 | 5 | 0.05 | 1431 | 1750 | 7.0 | 0.82 | 4.9 | Comparative Example |
| 111 | AI | 90 | 87 | 90 | 0.02 | 1384 | 1730 | 7.5 | 0.80 | 4.8 | Comparative Example |
| 112 | AJ | 79 | 78 | 75 | 0.04 | 1368 | 1710 | 7.0 | 0.80 | 4.8 | Comparative Example |
| 113 | AK | 93 | 91 | 75 | 0.07 | 1347 | 1630 | 7.8 | 0.83 | 4.2 | Comparative Example |
| 114 | AL | 90 | 86 | 80 | 0.02 | 1356 | 1620 | 7.9 | 0.84 | 4.9 | Comparative Example |
| 115 | AM | 96 | 85 | 90 | 0.14 | 1487 | 1660 | 7.9 | 0.90 | 4.8 | Comparative Example |
| 116 | AN | 94 | 85 | 65 | 0.13 | 1513 | 1730 | 7.7 | 0.87 | 4.8 | Comparative Example |

*1The total area fraction of one or both of B containing carbides having an average grain diameter of 50 nm or less and TM containing carbides having an average grain diameter of 50 nm or less in the whole microstructure

*2 The total area fraction of one or both of B containing carbides having an average grain diameter of 50 nm or less and TM containing carbides having an average grain diameter of 50 nm or less in a region (surface layer) from the surface of the base steel sheet to a position located at ⅛ of the thickness of the base steel sheet

*3The sum of perimeters of carbides having an average grain diameter of 0.1 μm or more and inclusions Underlined portions indicate items out of the range according to aspects of the present invention.

In the present EXAMPLES, a case where TS was 1320 MPa or more, YR was 0.80 or more, and R/t was less than 3.5 in the case of a tensile strength of 1320 MPa or more and less than 1530 MPa, less than 4.0 in the case of a tensile strength of 1530 MPa or more and less than 1700 MPa, and less than 4.5 in the case of a tensile strength of 1700 MPa or more was judged as satisfactory and shown as "Example" in Table 3-1 through Table 3-4. In addition, a case where TS was less than 1320 MPa, YR was less than 0.80, and R/t did not satisfy the requirements described above was judged as unsatisfactory and shown as "Comparative Example" in Table 3-1 through Table 3-4. Here, in Table 3-1 through Table 3-4, underlined portions indicate items which do not satisfy at least one of the requirements, the manufacturing conditions, and the properties according to aspects of the present invention.

The invention claimed is:

1. A high-yield-ratio high-strength electrogalvanized steel sheet having yield ratio of 0.80 or more and a tensile strength of 1320 MPa or more and comprising an electrogalvanized coating layer formed on a surface of a base steel sheet, wherein the base steel sheet has a chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.010% or less, and a balance of Fe and inevitable impurities, a steel microstructure, in which a total area fraction of one or both of bainite containing carbides having an average grain diameter of 50 nm or less and tempered martensite containing carbides having an average grain diameter of 50 nm or less is 90% or more in a whole of the steel microstructure, and in which a total area fraction of one or both of bainite containing carbides having an average grain diameter of 50 nm or less and tempered martensite containing carbides having an average grain diameter of 50 nm or less is 80% or more in a region from the surface of the base steel sheet to a position located at ⅛ of a thickness of the base steel sheet, and diffusible hydrogen in steel in an amount of 0.20 mass ppm or less, wherein a ratio R/t of a bending radius R of the high-yield-ratio high-strength electrogalvanized steel sheet to a thickness t of the high-yield-ratio high-strength electrogalvanized steel sheet is less than 3.5 in a case of a tensile strength of 1320 MPa or more and less than 1530 MPa, less than 4.0 in a case of a tensile strength of 1530 MPa or more and less than 1700 MPa, and less than 4.5 in a case of a tensile strength of 1700 MPa or more.

2. The high-yield-ratio high-strength electrogalvanized steel sheet according to claim 1, wherein the steel microstructure includes carbides having an average grain diameter of 0.1 μm or more and inclusions, and a sum of perimeters of the carbides having an average grain diameter of 0.1 μm or more and the inclusions is 50 μm/mm$^2$ or less.

3. The high-yield-ratio high-strength electrogalvanized steel sheet according to claim 1, wherein the chemical composition further contains, by mass %, at least one selected from the group consisting of:

group A: B: 0.0002% or more and less than 0.0035%;

group B: one or both selected from Nb: 0.002% or more and 0.08% or less and Ti: 0.002% or more and 0.12% or less;

group C: one or both selected from Cu: 0.005% or more and 1% or less and Ni: 0.01% or more and 1% or less;

group D: one, two, or more selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less;

group E: one, two, or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less; and group F: one or both selected from Sb: 0.002% or more and 0.1% or less and Sn: 0.002% or more and 0.1% or less.

4. The high-yield-ratio high-strength electrogalvanized steel sheet according to claim 2, wherein the chemical composition further contains, by mass %, at least one selected from the group consisting of:

group A: B: 0.0002% or more and less than 0.0035%;

group B: one or both selected from Nb: 0.002% or more and 0.08% or less and Ti: 0.002% or more and 0.12% or less;

group C: one or both selected from Cu: 0.005% or more and 1% or less and Ni: 0.01% or more and 1% or less;

group D: one, two, or more selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less;

group E: one, two, or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less; and group F: one or both selected from Sb: 0.002% or more and 0.1% or less and Sn: 0.002% or more and 0.1% or less.

5. A method for manufacturing the high-yield-ratio high-strength electrogalvanized steel sheet according to claim 1, the method comprising:

a hot rolling process of performing hot rolling on a steel slab having a steel slab chemical composition with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet, the steel slab chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.010% or less, and a balance of Fe and inevitable impurities;

an annealing process of holding the steel sheet obtained in the hot rolling process at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds; and an electroplating process of cooling the steel sheet after the annealing process to room temperature and performing an electrogalvanizing treatment on the cooled steel sheet for an electrogalvanizing time of 300 seconds or less.

6. A method for manufacturing the high-yield-ratio high-strength electrogalvanized steel sheet according to claim 2, the method comprising:

a hot rolling process of performing hot rolling on a steel slab having a steel slab chemical composition with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet, the steel slab chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.010% or less, and a balance of Fe and inevitable impurities;

an annealing process of holding the steel sheet obtained in the hot rolling process at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds; and an electroplating process of cooling the steel sheet after the annealing process to room temperature and performing an electrogalvanizing treatment on the cooled steel sheet for an electrogalvanizing time of 300 seconds or less.

7. A method for manufacturing the high-yield-ratio high-strength electrogalvanized steel sheet according to claim 3, the method comprising:

a hot rolling process of performing hot rolling on a steel slab having a steel slab chemical composition with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet, the steel slab chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.010% or less, and further containing, by mass %, at least one selected from the group consisting of group A: B: 0.0002% or more and less than 0.0035%; group B: one or both selected from Nb: 0.002% or more and 0.08% or less and Ti: 0.002% or more and 0.12% or less; group C: one or both selected from Cu: 0.005% or more and 1% or less and Ni: 0.01% or more and 1% or less; group D: one, two, or more selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less; group E: one, two, or more selected from Ca: 0.0002% or more and 0.0030% or less, Ce: 0.0002% or more and 0.0030% or less, La: 0.0002% or more and 0.0030% or less, and Ma: 0.0002% or more and 0.0030% or less; group F: one or both selected from Sb: 0.002% or more and 0.1% or less and Sn: 0.002% or more and 0.1% or less, and a balance of Fe and inevitable impurities;

an annealing process of holding the steel sheet obtained in the hot rolling process at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds; and an electroplating process of cooling the steel sheet after the annealing process to room temperature and performing an electrogalvanizing treatment on the cooled steel sheet for an electrogalvanizing time of 300 seconds or less.

8. A method for manufacturing the high-yield-ratio high-strength electrogalvanized steel sheet according to claim 4, the method comprising:

a hot rolling process of performing hot rolling on a steel slab having a steel slab chemical composition with a slab heating temperature of 1200° C. or higher and a finishing delivery temperature of 840° C. or higher, cooling the hot-rolled steel sheet to a primary cooling stop temperature of 700° C. or lower in such a manner that cooling is performed at an average cooling rate of 40° C./sec or higher in a temperature range from the finishing delivery temperature to a temperature of 700° C., further cooling the cooled steel sheet to a coiling temperature of 630° C. or lower in such a manner that cooling is performed at an average cooling rate of 2° C./sec or higher in a temperature range from the primary cooling stop temperature to a temperature of 650° C., and coiling the cooled steel sheet, the steel slab chemical composition containing, by mass %, C: 0.14% or more and 0.40% or less, Si: 0.001% or more and 2.0% or less, Mn: 0.10% or more and 1.70% or less, P: 0.05% or less, S: 0.0050% or less, Al: 0.01% or more and 0.20% or less, N: 0.01% or less, and further containing, by mass %, at least one selected from the group consisting of group A: B: 0.0002% or more and less than 0.0035%; group B: one or both selected from Nb: 0.0002% or more and 0.08% or less and Ti: 0.002% or more and 0.12% or less; around C: one or both selected from Cu: 0.005% or more and 1% or less and Ni: 0.01% or more and 1% or less; group D: one, two, or more selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less; group E: one, two, or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less; group F: one or both selected from Sb: 0.002% or more and 0.1% or less and Sn: 0.002% or more and 0.1% or less, and a balance of Fe and inevitable impurities;

an annealing process of holding the steel sheet obtained in the hot rolling process at an annealing temperature equal to or higher than the $A_{C3}$ temperature for 30 seconds or more, cooling the held steel sheet from a cooling start temperature of 680° C. or higher to a cooling stop temperature of 260° C. or lower in such a manner that cooling is performed at an average cooling rate of 70° C./sec or higher in a temperature range of 680° C. to 260° C., and holding the cooled steel sheet at a holding temperature of 150° C. to 260° C. for 20 seconds to 1500 seconds; and an electroplating process of cooling the steel sheet after the annealing process to room temperature and performing an electrogalvanizing treatment on the cooled steel sheet for an electrogalvanizing time of 300 seconds or less.

9. The method according to claim 5, the method further comprising a cold rolling process of performing cold rolling on the steel sheet after the hot rolling process between the hot rolling process and the annealing process.

10. The method according to claim 6, the method further comprising a cold rolling process of performing cold rolling on the steel sheet after the hot rolling process between the hot rolling process and the annealing process.

11. The method according to claim 7, the method further comprising a cold rolling process of performing cold rolling on the steel sheet after the hot rolling process between the hot rolling process and the annealing process.

12. The method for manufacturing a high yield ratio high strength electrogalvanized steel sheet according to claim 8, the method further comprising a cold rolling process of performing cold rolling on the steel sheet after the hot rolling process between the hot rolling process and the annealing process.

13. The method according to claim 5, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

14. The method according to claim 6, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

15. The method according to claim 7, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

16. The method according to claim 8, the method further comprising a tempering process of holding the steel sheet after the electroplating process in a tempera re range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

17. The method according to claim 9, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

18. The method according to claim 10, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

19. The method according to claim 11, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

20. The method according to claim 12, the method further comprising a tempering process of holding the steel sheet after the electroplating process in a temperature range of 250° C. or lower for a holding time t which satisfies relational expression (1) below:

$$(T+273)(\log t+4)\leq 2700 \quad (1),$$

where, in relational expression (1), T denotes a holding temperature in ° C. in the tempering process and t denotes the holding time in seconds in the tempering process.

21. The method according to claim 5, wherein a rolling time in a temperature range from a temperature of 1150° C. to the finishing delivery temperature in the hot rolling process is 200 seconds or less.

22. The method for according to claim 6, wherein a rolling time in a temperature range from a temperature of 1150° C. to the finishing delivery temperature in the hot rolling process is 200 seconds or less.

23. The method according to claim 7, wherein a rolling time in a temperature range from a temperature of 1150° C. to the finishing delivery temperature in the hot rolling process is 200 seconds or less.

24. The method according to claim 8, wherein a rolling time in a temperature range from a temperature of 1150° C. to the finishing delivery temperature in the hot rolling process is 200 seconds or less.

25. The method according to claim 9, wherein a rolling time in a temperature range from a temperature of 1150° C. to the finishing delivery temperature in the hot rolling process is 200 seconds or less.

26. The method according to claim 10, wherein a rolling time in a temperature range from a temperature of 1150° C. to the finishing delivery temperature in the hot rolling process is 200 seconds or less.

27. The method according to claim 11, wherein a rolling time in a temperature range from a temperature of 1150° C. to the finishing delivery temperature in the hot rolling process is 200 seconds or less.

28. The method according to claim 12, wherein a rolling time in a temperature range from a temperature of 1150° C. to the finishing delivery temperature in the hot rolling process is 200 seconds or less.

29. The method according to claim 13, wherein a rolling time in a temperature range from a temperature of 1150° C. to the finishing delivery temperature in the hot rolling process is 200 seconds or less.

30. The method according to claim 14, wherein a rolling time in a temperature range from a temperature of 1150° C. to the finishing delivery temperature in the hot rolling process is 200 seconds or less.

31. The method according to claim 15, wherein a rolling time in a temperature range from a temperature of 1150° C. to the finishing delivery temperature in the hot rolling process is 200 seconds or less.

32. The method according to claim 16, wherein a rolling time in a temperature range from a temperature of 1150° C.

to the finishing delivery temperature in the hot rolling process is 200 seconds or less.

33. The method according to claim 17, wherein a rolling time in a temperature range from a temperature of 1150° C. to the finishing delivery temperature in the hot rolling process is 200 seconds or less.

34. The method according to claim 18, wherein a rolling time in a temperature range from a temperature of 1150° C. to the finishing delivery temperature in the hot rolling process is 200 seconds or less.

35. The method according to claim 19, wherein a rolling time in a temperature range from a temperature of 1150° C. to the finishing delivery temperature in the hot rolling process is 200 seconds or less.

36. The method according to claim 20, wherein a rolling time in a temperature range from a temperature of 1150° C. to the finishing delivery temperature in the hot rolling process is 200 seconds or less.

* * * * *